US007656359B2

(12) United States Patent
Haziza

(10) Patent No.: US 7,656,359 B2
(45) Date of Patent: Feb. 2, 2010

(54) APPARATUS AND METHOD FOR ANTENNA RF FEED

(75) Inventor: Dedi David Haziza, San Jose, CA (US)

(73) Assignee: Wavebender, Inc., Santa Clara, CA (US)

( * ) Notice: Subject to any disclaimer, the term of this patent is extended or adjusted under 35 U.S.C. 154(b) by 162 days.

(21) Appl. No.: 11/932,361

(22) Filed: Oct. 31, 2007

(65) Prior Publication Data

US 2008/0117114 A1 May 22, 2008

Related U.S. Application Data

(63) Continuation-in-part of application No. 11/695,913, filed on Apr. 3, 2007, now Pat. No. 7,466,281.

(60) Provisional application No. 60/808,187, filed on May 24, 2006, provisional application No. 60/859,667, filed on Nov. 17, 2006, provisional application No. 60/859,799, filed on Nov. 17, 2006, provisional application No. 60/890,456, filed on Feb. 16, 2007.

(51) Int. Cl.
*H01Q 13/00* (2006.01)

(52) U.S. Cl. ..... 343/772; 343/786

(58) Field of Classification Search ..... 343/700 MS, 343/772, 776, 786
See application file for complete search history.

(56) References Cited

U.S. PATENT DOCUMENTS 2,994,873 A * 8/1961 Goubau ..... 343/753
3,109,174 A * 10/1963 Plummer ..... 342/368
3,205,498 A * 9/1965 Child ..... 343/705
3,818,490 A 6/1974 Leahy
3,942,180 A 3/1976 Rannou et al.
4,090,203 A * 5/1978 Duncan ..... 343/753
4,644,343 A 2/1987 Schneider et al.
4,783,665 A 11/1988 Lier et al.
5,793,334 A 8/1998 Anderson et al.
5,943,023 A 8/1999 Sanford
6,831,613 B1 * 12/2004 Gothard et al. ..... 343/779
7,030,824 B1 * 4/2006 Taft et al. ..... 343/767
2003/0038745 A1 2/2003 Lalezari et al.
2003/0122724 A1 7/2003 Shelley et al.
2004/0246069 A1 12/2004 Yoneda et al.
2005/0146478 A1 7/2005 Wang et al.
2005/0174290 A1 8/2005 Huang
2006/0055605 A1 3/2006 Peled et al.

OTHER PUBLICATIONS

International Search Report for PCT Application No. PCT/US07/24047 dated May 2, 2008.
International Search Report for PCT Application No. PCT/US07/12004 dated Jul. 7, 2008.

(Continued)

*Primary Examiner*—Shih-Chao Chen
(74) *Attorney, Agent, or Firm*—Nixon Peabody LLP.; Joseph Bach, Esq.

(57) ABSTRACT

An RF feed is provided which is structured as a curved reflector coupled to a sidewall of a waveguide cavity. A radiation source is situated facing the curved reflector. The RF feed may be coupled to a waveguide cavity having radiation elements coupled to top surface thereof, to thereby feed an antenna array. When an antenna array is used, several curved reflector RF feeds may be used, operating in the same or different frequencies.

20 Claims, 17 Drawing Sheets

OTHER PUBLICATIONS

International Search Report for PCT Application No. PCT/US07/24027 dated May 14, 2008.
International Search Report for PCT Application No. PCT/US07/24028 dated May 20, 2008.
International Search Report for PCT Application No. PCT/US07/24029 dated May 14, 2008.
International Search Report for PCT Application No. PCT/US07/08418 dated Jul. 8, 2008.

* cited by examiner

APPARATUS AND METHOD FOR ANTENNA RF FEED

CROSS-REFERENCE TO RELATED APPLICATIONS

This application is a continuation of and claims priority from U.S. application Ser. No. 60/808,187, filed May 24, 2006; U.S. Application Ser. No. 60/859,667, filed Nov. 17, 2006; U.S. Application Ser. No. 60/859,799, filed Nov. 17, 2006; and U.S. Application Ser. No. 60/890,456, filed Feb. 16, 2007, this Application is further a continuation-in-part and claims priority from U.S. application Ser. No. 11/695,913, filed Apr. 3, 2007 now U.S. Pat. No. 7,466,281, the disclosure of all of which is incorporated herein by reference in its entirety.

BACKGROUND

1. Field of the Invention

The general field of the invention relates to a unique RF feeding arrangement for radiating electromagnetic devices, such as antenna and antenna array.

2. Related Arts

Various antennas are known in the art for receiving and transmitting electro-magnetic radiation. Physically, an antenna consists of a radiating element made of conductors that generate radiating electromagnetic field in response to an applied electric and the associated magnetic field. The process is bi-directional, i.e., when placed in an electromagnetic field, the field will induce an alternating current in the antenna and a voltage would be generated between the antenna's terminals or structure. The feed network, or transmission network, conveys the signal between the antenna and the transceiver (source or receiver). The feeding network may include antenna coupling networks and/or waveguides. An antenna array refers to two or more antennas coupled to a common source or load so as to produce a directional radiation pattern. The spatial relationship between individual antennas contributes to the directivity of the antenna.

While the antenna disclosed herein is generic and may be applicable to a multitude of applications, one particular application that can immensely benefit from the subject antenna is the reception of satellite television (Direct Broadcast Satellite, or "DBS"), both in a stationary and mobile setting. Fixed DBS, reception is accomplished with a directional antenna aimed at a geostationary satellite. In mobile DBS, the antenna is situated on a moving vehicle (earth bound, marine, or airborne). In such a situation, as the vehicle moves, the antenna needs to be continuously aimed at the satellite. Various mechanisms are used to cause the antenna to track the satellite during motion, such as a motorized mechanism and/or use of phase-shift antenna arrays. Further general information about mobile DBS can be found in, e.g., U.S. Pat. No. 6,529,706, which is incorporated herein by reference.

One known two-dimensional beam steering antenna uses a phased array design, in which each element of the array has a phase shifter and amplifier connected thereto. A typical array design for planar arrays uses either micro-strip technology or slotted waveguide technology (see, e.g., U.S. Pat. No. 5,579,019). With micro-strip technology, antenna efficiency greatly diminishes as the size of the antenna increases. With slotted waveguide technology, the systems incorporate complex components and bends, and very narrow slots, the dimensions and geometry of all of which have to be tightly controlled during the manufacturing process. The phase shifters and amplifiers are used to provide two-dimensional, hemispherical coverage. However, phase shifters are costly and, particularly if the phased array incorporates many elements, the overall antenna cost can be quite high. Also, phase shifters require separate, complex control circuitry, which translates into unreasonable cost and system complexity.

A technology similar to DBS, called GBS (Global Broadcast Service) uses commercial-off-the-shelf technologies to provide wideband data and real-time video via satellite to a diverse user community associated with the US Government. The GBS system developed by the Space Technology Branch of Communication-Electronics Command's Space and Terrestrial Communications Directorate uses a slotted waveguide antenna with a mechanized tracking system. While that antenna is said to have a low profile—extending to a height of "only" 14 inches without the radome (radar dome)—its size may be acceptable for military applications, but not acceptable for consumer applications, e.g., for private automobiles. For consumer applications the antenna should be of such a low profile as not to degrade the aesthetic appearance of the vehicle and not to significantly increase its drag coefficient.

Current mobile systems are expensive and complex. In practical consumer products, size and cost are major factors, and providing a substantial reduction of size and cost is difficult. In addition to the cost, the phase shifters of known systems inherently add loss to the respective systems (e.g., 3 dB losses or more), thus requiring a substantial increase in antenna size in order to compensate for the loss. In a particular case, such as a DBS antenna system, the size might reach 4 feet by 4 feet, which is impractical for consumer applications.

As can be understood from the above discussion, in order to develop a mobile DBS or GBS system for consumers, at least the following issues must be addressed: increased efficiency of signal collection, reduction in size, and reduction in price. Current antenna systems are relatively too large for commercial use, have problems with collection efficiency, and are priced in the thousands, or even tens of thousands of dollars, thereby being way beyond the reach of the average consumer. In general, the efficiency discussed herein refers to the antenna's efficiency of collecting the radio-frequency signal the antenna receives into an electrical signal. This issue is generic to any antenna system, and the solutions provided herein address this issue for any antenna system used for any application, whether stationary or mobile.

SUMMARY

The following summary of the invention is provided in order to provide a basic understanding of some aspects and features of the invention. This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

Embodiments of the present invention provide an RF feed including a waveguide, a curved reflector coupled to an opening at a side of the waveguide, and a radiation source provided in the space between the opening at the side of the waveguide and the curved reflector. The curved reflector may be a three-dimensionally shaped surface. In various aspect of the invention, the curved reflector may be cylindrical, parabolic or toroidal. A counter-reflector may be situated opposite the radiation source and facing the curved reflector. The radiation source may include a metallic pin, a waveguide horn opening, or a microstrip patch.

In one aspect of the invention, the waveguide includes a top surface, a bottom surface and a sidewall, and the RF feed further includes an extension coupled to the opening in the sidewall, and the curved reflector is provided under the bottom surface and is coupled to the extension.

In one aspect, the radiation source comprises a plurality of metallic pins arranged linearly. In one aspect the radiation source comprises a plurality of metallic pins arranged on a curve. In one aspect, the radiation source comprises a plurality of waveguide horns. In one aspect, the radiation source comprises a plurality of microstrip patches.

In one aspect of the invention, the curved reflector is shaped according to a function designed to reflect radiation received from the radiation source to thereby produce a linear wave front at the opening at the side of the waveguide.

In one aspect, the RF feed further includes a second curved reflector coupled to a second opening at a second side of the waveguide, and a second radiation source provided in the space between the second opening at the second side of the waveguide and the second curved reflector.

In one aspect, the second curved reflector is shaped according to a function designed to reflect radiation received from the second radiation source to thereby produce a second linear wave front at the second opening at the second side of the waveguide In one aspect, the linear opening and the second opening are at right angles to each other. In one aspect, the radiation source comprises a movable metallic pin. In one aspect, the curved reflector is smaller than the second curved reflector.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 8D illustrate a top view of a square circularly polarizing radiating element, while

DETAILED DESCRIPTION

Various embodiments of the invention are generally directed to radiating elements and antenna structures and systems incorporating the radiating element. The various embodiments described herein may be used, for example, in connection with stationary and/or mobile platforms. Of course, the various antennas and techniques described herein may have other applications not specifically mentioned herein. Mobile applications may include, for example, mobile DBS or VSAT integrated into land, sea, or airborne vehicles. The various techniques may also be used for two-way communication and/or other receive-only applications.

According to an embodiment of the present invention, a radiating element is disclosed, which is used in single or in an array to form an antenna. The radiating structure may take on various shapes, selected according to the particular purpose and application in which the antenna will be used. The shape of the radiating element or the array of elements can be designed so as to control the phase and amplitude of the signal, and the shape and directionality of the radiating/receiving beam. Further, the shape can be used to change the gain of the antenna. The disclosed radiating elements are easy to manufacture and require relatively loose manufacturing tolerances; however, they provide high gain and wide bandwidth. According to various embodiments disclosed, linear or circular polarization can be designed into the radiating element. Further, by various feeding mechanisms, the directionality of the antenna may be steered, thereby enabling it to track a satellite from a moving platform, or to be used with multiple satellites or targets, depending on the application, by enabling multi-beam operation.

According to one embodiment of the present invention, an antenna structure is provided. The antenna structure may be generally described as a planar-fed, open waveguide antenna. The antenna may use a single radiating element or an array of elements structured as a linear array, a two-dimensional array, a circular array, etc. The antenna uses a unique open wave extension as a radiating element of the array. The extension radiating element is constructed so that it couples the wave energy directly from the wave guide.

The element may be extruded from the top of a multi-mode waveguide, and may be fed using a planar wave excitation into a closed common planar waveguide section. The element(s) may be extruded from one side of the planar waveguide. The radiating elements may have any of a number of geometric shapes including, without limitation, a cross, a rectangle, a cone, a cylinder, or other shapes.

Figure 1A:
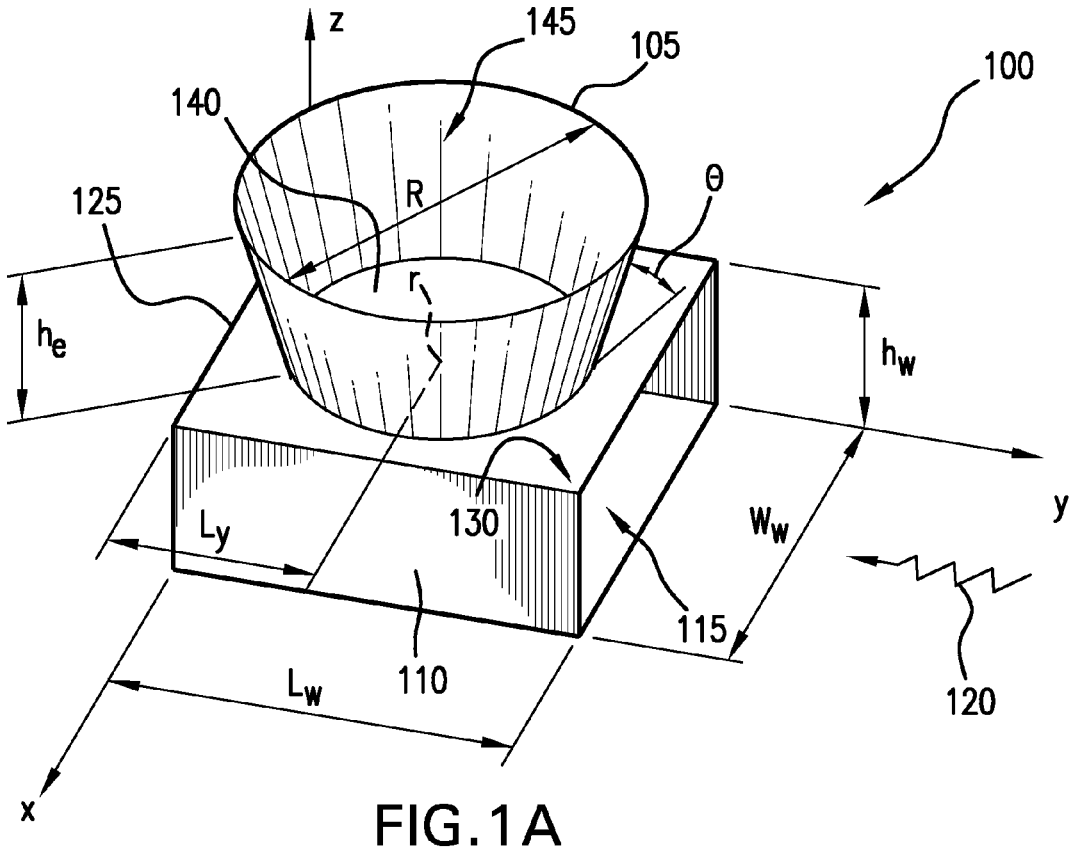
FIGS. 1A and 1B depict an example of an antenna according to an embodiment of the invention.
Figure 1B:
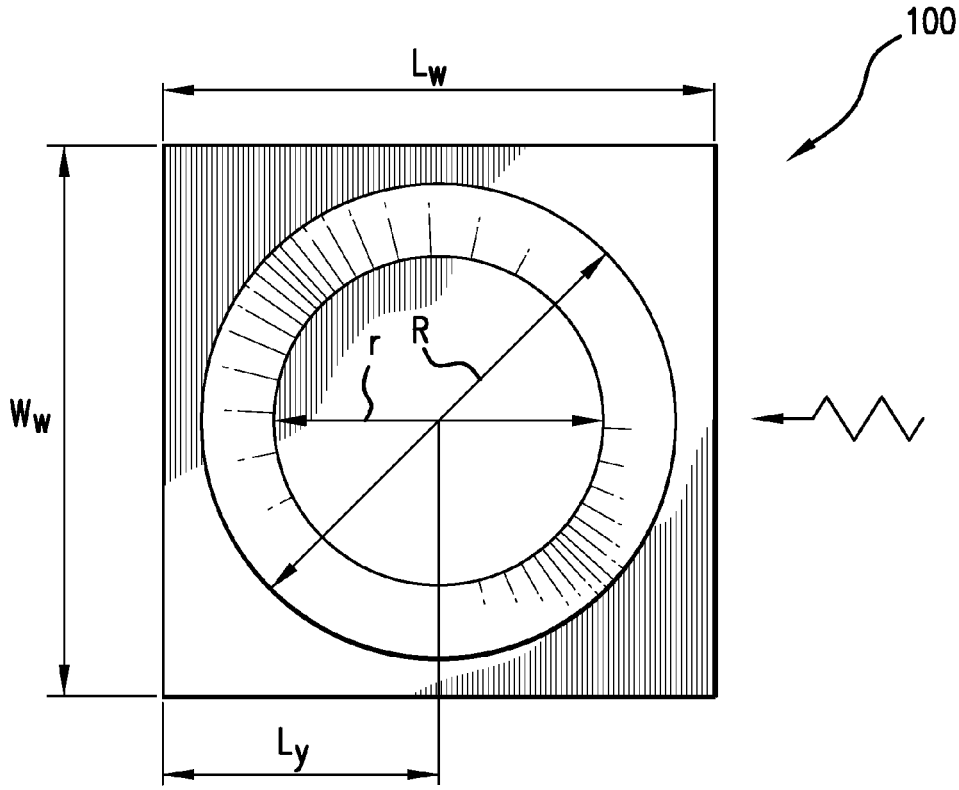

FIGS. 1A and 1B depict an example of an antenna 100 according to an embodiment of the invention. FIG. 1A depicts a perspective view, while FIG. 1B depicts a top elevation. The antenna 100 comprises a single radiating element 105 coupled to waveguide 110. The radiating element 105 and waveguide 110 together form an antenna 100 having a beam shape that is generally hemispherical, but the shape may be controlled by the geometry of radiating element 105, as will be explained further below. The waveguide may be any conventional waveguide, and in this example is shown as having a parallel plate cavity using a simple rectangular geometry having a single opening 115 serving as the wave port/excitation port, via which the wave energy 120 is transmitted.

For clearer understanding, the waveguide is shown superimposed over Cartesian coordinates, wherein the wave energy within the waveguide propagates in the Y-direction, while the energy emanating from or received by the radiating element 105 propagates generally in the Z-direction. The height of the waveguide $h_w$ is generally defined by the frequency and may be set between $0.1\lambda$ and $0.5\lambda$. For best results the height of the waveguide $h_w$ is generally set in the range $0.33\lambda$ to $0.25\lambda$. The width of the waveguide $W_w$ may be chosen independently of the frequency, and is generally selected in consideration of the physical size limitations and gain requirements. Increasing width would lead to increased gain, but for some applications size considerations may dictate reducing the total size of the antenna, which would require limiting the width. The length of the waveguide $L_w$ is also chosen independently of the frequency, and is also selected based on size and gain considerations. However, in embodiments where the backside 125 is close, it serves as a cavity boundary, and the length $L_y$ from the cavity boundary 125 to the center of the element 105 should be chosen in relation to the frequency. That is, where the backside 125 is closed, if some part of the propagating wave 120 continues to propagate passed the element 105, the remainder would be reflected from the backside 125. Therefore, the length Ly should be set so as to ensure that the reflection is in phase with the propagating wave.

Attention is now turned to the design of the radiating element 105. In this particular embodiment the radiating element is in a cone shape, but other shapes may be used, as will be described later with respect to other embodiments. The radiating element is physically coupled directly to the waveguide, over an aperture 140 in the waveguide. The aperture 140 serves as the coupling aperture for coupling the wave energy between the waveguide and the radiating element. The upper opening, 145, of the radiating element is referred to herein as the radiating aperture. The height $h_e$ of the radiating element 105 effects the phase of the energy that hits the upper surface 130 of the waveguide 110. The height is generally set to approximately $0.25\lambda_0$ in order to have the reflected wave in phase. The lower radius r of the radiating element affects the coupling efficiency and the total area $\pi r^2$ defines the gain of the antenna. On the other hand, the angle θ (and correspondingly radius R) defines the beam's shape and may be 90° or less. As angle θ is made to be less than 90°, i.e., R>r, the beam's shape narrows, thereby providing more directionality to the antenna 100.

Figure 2:
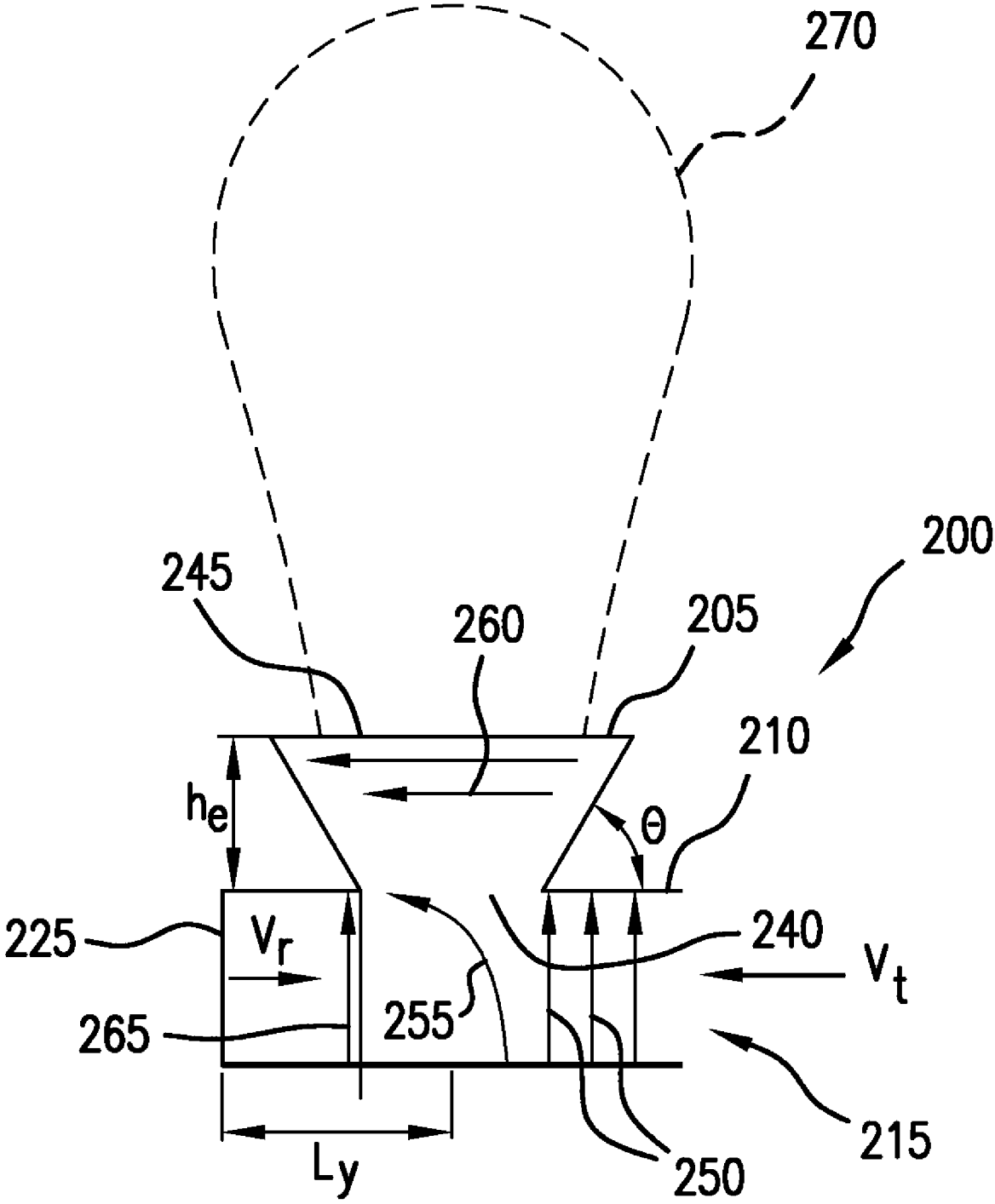
FIG. 2 illustrates a cross section of an antenna according to the embodiment of FIGS. 1A and 1B.

FIG. 2 illustrates a cross section of an antenna according to the embodiment of FIGS. 1A and 1B. The cross section of FIG. 2 is a schematic illustration that may be used to assist the reader in understanding of the operation of the antenna 200. As is shown, waveguide 210 has a wave port 215 through which a radiating wave is transmitted. The radiating element 205 is provided over the coupling port 240 of the waveguide 210 and has an upper radiating port 245. An explanation of the operation of the antenna will now be provided in the case of a transmission of a signal, but it should be apparent that the exact reverse operation occurs during reception of a signal.

In FIG. 2, the wave front is schematically illustrated as arrows 250, entering via wave port 215 and propagating in the direction Vt. As the wave reaches the coupling port 240, at least part of its energy is coupled into the radiating element 205 by assuming an orthogonal propagation direction, as schematically illustrated by bent arrow 255. The coupled energy then propagates along radiating element 205, as shown by arrows 260, and finally is radiated at a directionality as illustrated by broken line 270. The remaining energy, if any, continues to propagate until it hits the cavity boundary 225. It then reflects and reverses direction as shown by arrow Vr. Therefore, the distance Ly should be made to ensure that the reflecting wave returns in phase with the propagating wave.

Using the inventive principles, transmission of wave energy is implemented by the following steps: generating from a transmission port a planar electromagnetic wave at a face of a waveguide cavity; propagating the wave inside the cavity in a propagation direction; coupling energy from the propagating wave onto a radiating element by redirecting at least part of the wave to propagate along the radiating element in a direction orthogonal (or other angle) to the propagation direction; and radiating the wave energy from the radiating element to free space. The method of receiving the radiation energy is completely symmetrical in the reverse order. That is, the method proceeds by coupling wave energy onto the radiating element; propagating the wave along the radiating element in a propagation direction; coupling energy from the propagating wave onto a cavity by redirecting the wave to propagate along the cavity in a direction orthogonal to the propagation direction; and collecting the wave energy at a receiving port.

Figure 3A:
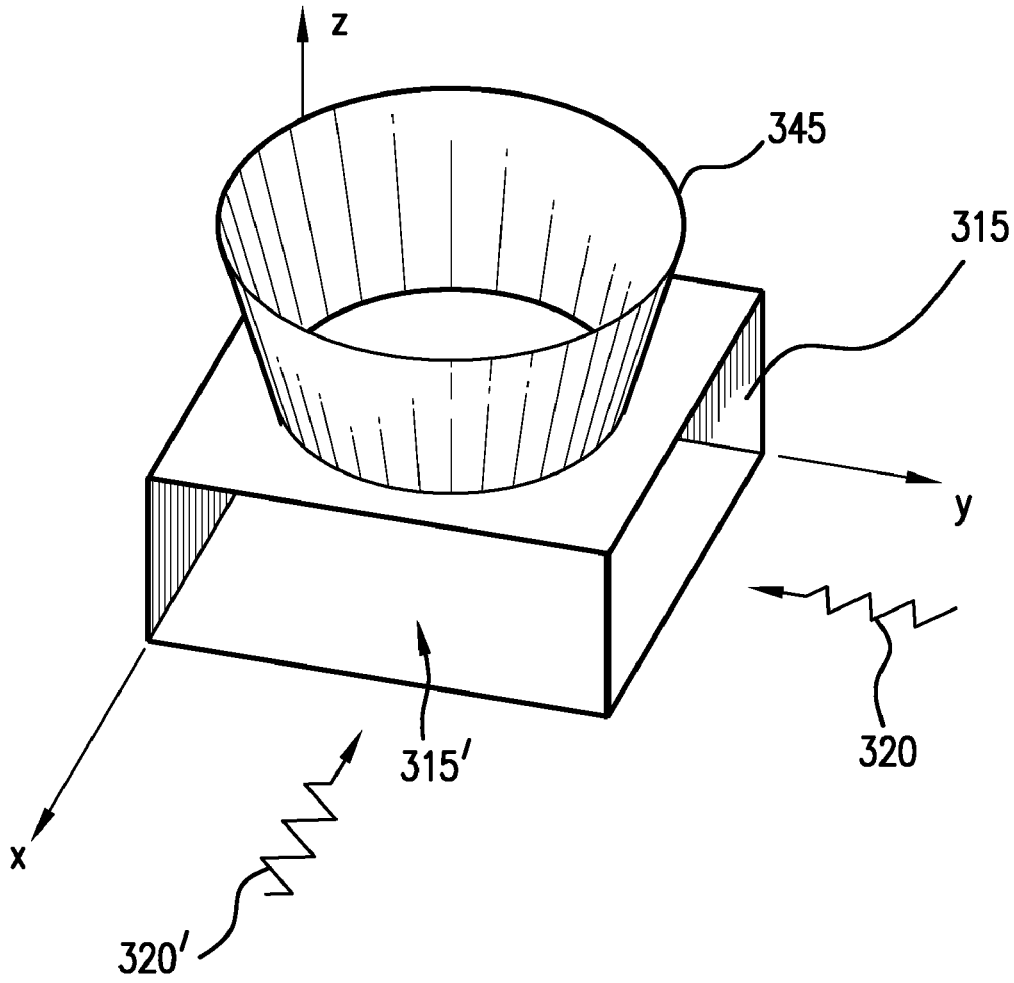
FIG. 3A depicts an embodiment of an antenna that may be used to transmit/receive two waves of cross polarization.

The antenna of the embodiments of FIGS. 1A, 1B and 2, can be used to transmit and receive a linearly or circularly polarized wave. FIG. 3A, on the other hand, depicts an embodiment of an antenna that may be used to transmit/receive two waves of cross polarization. Notably, in the embodiment of FIG. 3A, two excitation ports, 315 and 315' are provided on the waveguide. A first wave, 320, of a first polarization enters the waveguide cavity via port 315, while another wave 320', of different polarization, enters the waveguide cavity via port 315'. Both waves are radiated via radiating aperture 345, while maintaining their orthogonal polarization.

Figure 3B:
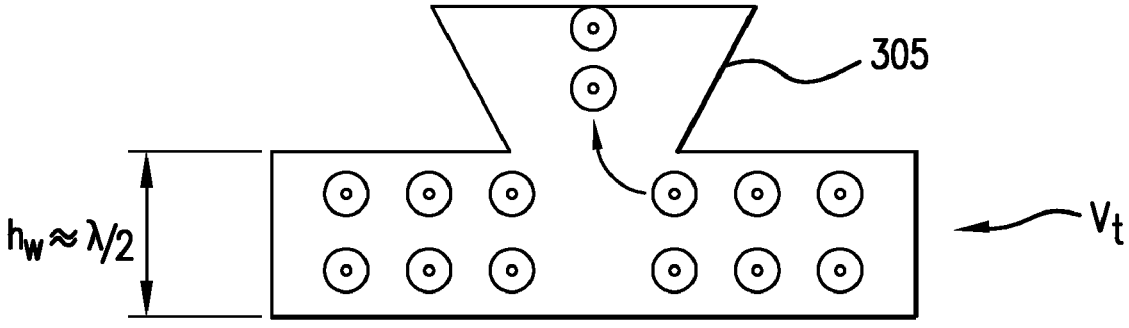
FIG. 3B depicts a cross section similar to that of FIG. 2, except that the arrangement enables excitation of two orthogonal polarizations from the same face.

On the other hand, the embodiment of FIGS. 1A and 1B may also be used to transmit/receive two waves of cross polarization. This is explained with respect to FIG. 3B. FIG. 3B shows a cross section similar to that of FIG. 2, except that the height of the waveguide $h_w$ is set to about $\lambda/2$. In this case, if the originating wave has vertical polarization, such as shown in FIG. 2, the transmitted wave will assume a horizontal polarization, as shown in FIG. 2. On the other hand, if the originating wave has a horizontal polarization, as shown in FIG. 3, the wave is coupled to the radiating element 305 and is radiated with a horizontal polarization that is orthogonal to the wave shown in FIG. 2. In this manner, one may feed either on or both waves so as to obtain any polarization required. It should be appreciated that the two polarizations can be combined into any arbitrary polarization by adjusting the phase and amplitude of the two wave sources which excite the antenna.

Figure 4:
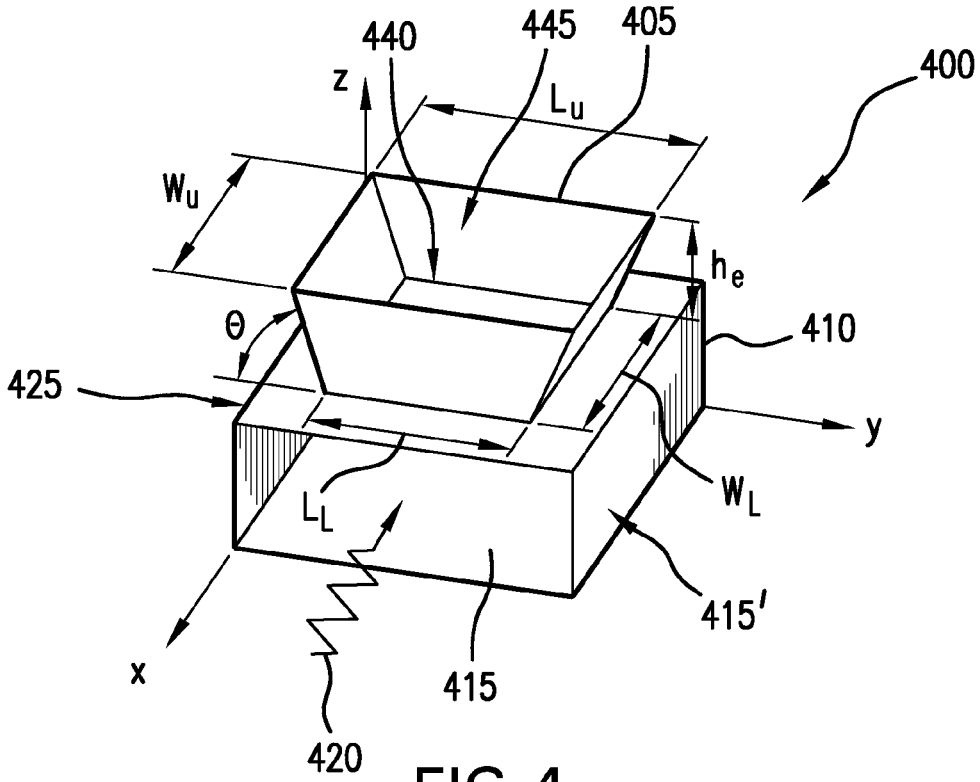
FIG. 4 depicts an antenna according to another embodiment of the invention.

FIG. 4 depicts an antenna according to another embodiment of the invention. In FIG. 4, Antenna 400 comprises radiating element 405 coupled to waveguide 410, over coupling port 440. In this embodiment the radiating element 405 has generally a polygon cross-section. The height $h_e$ of the element 405 may be selected as in the previous embodiments, e.g., $0.25\lambda$. The bottom width $w_L$ of the element determines the coupling efficiency of the element, while the bottom length $L_L$ defines the lowest frequency at which the antenna can operate at. The area of the radiating aperture 445, i.e., $w_u \times L_u$ defines the gain of the antenna. The angle $\theta$, as with the previous embodiments, defines the beam's shape and may be 90° or less. In the embodiment depicted, wave 420, having a first polarization, enters via the single excitation port 415. However, as discussed above with respect to the other embodiments, another excitation port may be provided, for example, instead of cavity boundary 415'. In such a case, a second wave may be coupled, having an orthogonal polarization to wave 420.

Figure 5:
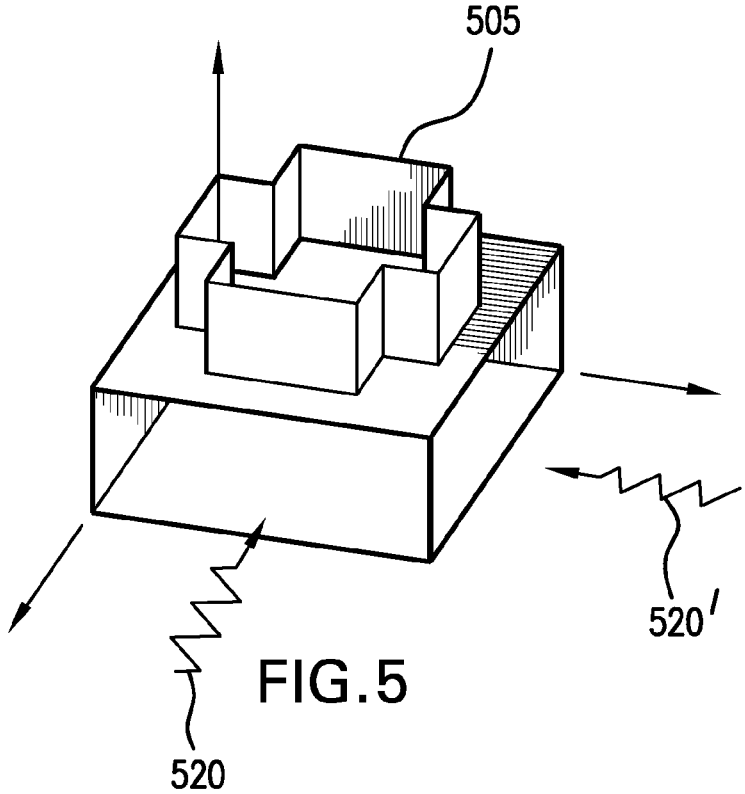
FIG. 5 depicts another embodiment of an antenna according to the subject invention.
Figure 6:
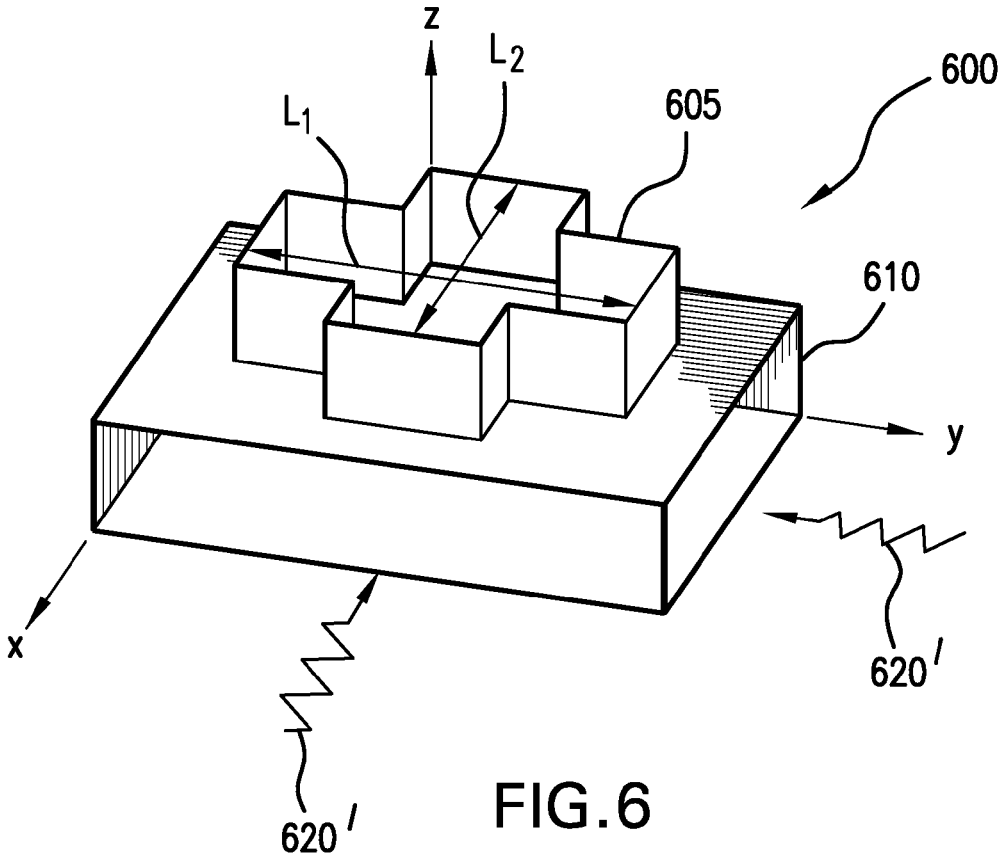
FIG. 6 illustrates an embodiment optimized for operation at two different frequencies and optionally two different polarizations.

FIG. 5 depicts another embodiment of an antenna according to the subject invention. The embodiment of FIG. 5 is optimized for operation at two orthogonal polarizations. The radiating element 505 has a cross-section in the shape of a cross that is formed by two superimposed rectangles. In this manner, one rectangle is optimized for radiating wave 520, while the other rectangle is optimized for radiating wave 520'. Waves 520 and 520' have orthogonal linear polarization. In the embodiment of FIG. 5 the two superimposed rectangles forming the cross-shape have the same length, so as to operate two waves of similar frequency, but cross-polarization. On the other hand, FIG. 6 illustrates an embodiment optimized for operation at two different frequencies and optionally two different polarizations. As can be seen, the main different between the embodiment of FIGS. 5 and 6 is that the radiating element of FIG. 6 has a cross-section in the shape of a cross formed by superimposed rectangles having different lengths. That is, length L1 is optimized for operation in the frequency of wave 620, while wave L2 is optimized for operation at frequency of wave 620'. Waves 620 and 620' may be cross-polarized. The intersecting waveguides forming the cross may also be constructed using a centrally located ridge in each waveguide, with the dimensional parameters of the ridge along with L1 and L2 optimized to provide broadband frequency operation.

Figure 7:
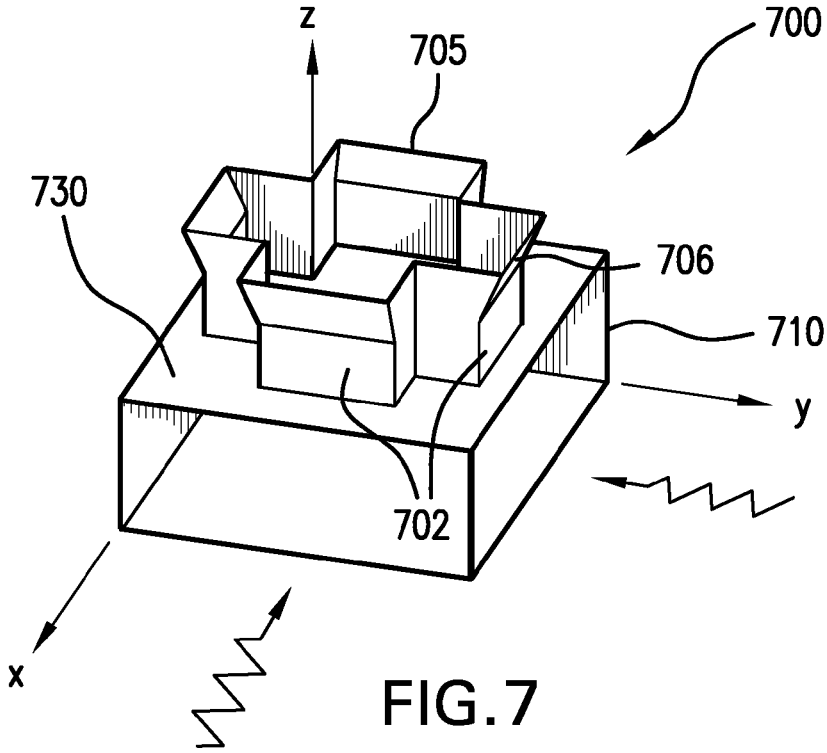
FIG. 7 depicts an embodiment of the invention using a radiating element having flared sidewalls.

FIG. 7 depicts an embodiment of the invention using a radiating element 705 having flared sidewalls. Each element comprises a lower perpendicular section and an upper flared section. The sides 702 of the perpendicular section define planes which are perpendicular to the upper surface 730 of the waveguide 710, where the coupling aperture (not shown) is provided. The sides 704 of the flared section define planes which are angularly offset from, and non-perpendicular to the plane defined by the upper surface 730 of the waveguide 710. The element 705 of FIG. 7 is similar to the elements shown in FIGS. 5 and 6, in that it is optimized for operating with two waves having similar or different frequencies and optionally at cross polarization. However, by introducing the flare on the sidewalls, the design of the coupling aperture can be made independently of the design of the radiating aperture. This is similar to the case illustrated in the previous embodiments where the sidewalls are provided at an angle $\theta$ less than 90°.

According to one feature of the invention, wide band capabilities may be provided by a wideband XPD (cross polar discrimination), circular polarization element. One difficulty in generating a circular polarization wave is the need for a complicated feed network using hybrids, or feeding the element from two orthogonal points. Another possibility is using corner-fed or slot elements. Current technology using these methods negatively impacts the bandwidth needed for good cross-polarization performance, as well as the cost and complexity of the system. Alternate solutions usually applied in waveguide antennas (e.g., horns) require the use of an external polarizer (e.g., metallic or dielectric) integrated into the cavity. In the past, this has been implemented in single-horn antennas only. Thus, there is a need for a robust wideband circular polarization generator element, which can be built in into large array antennas, while maintaining easy installation and integration of the polarization element in the manufacturing process of the antenna.

Figure 8A:
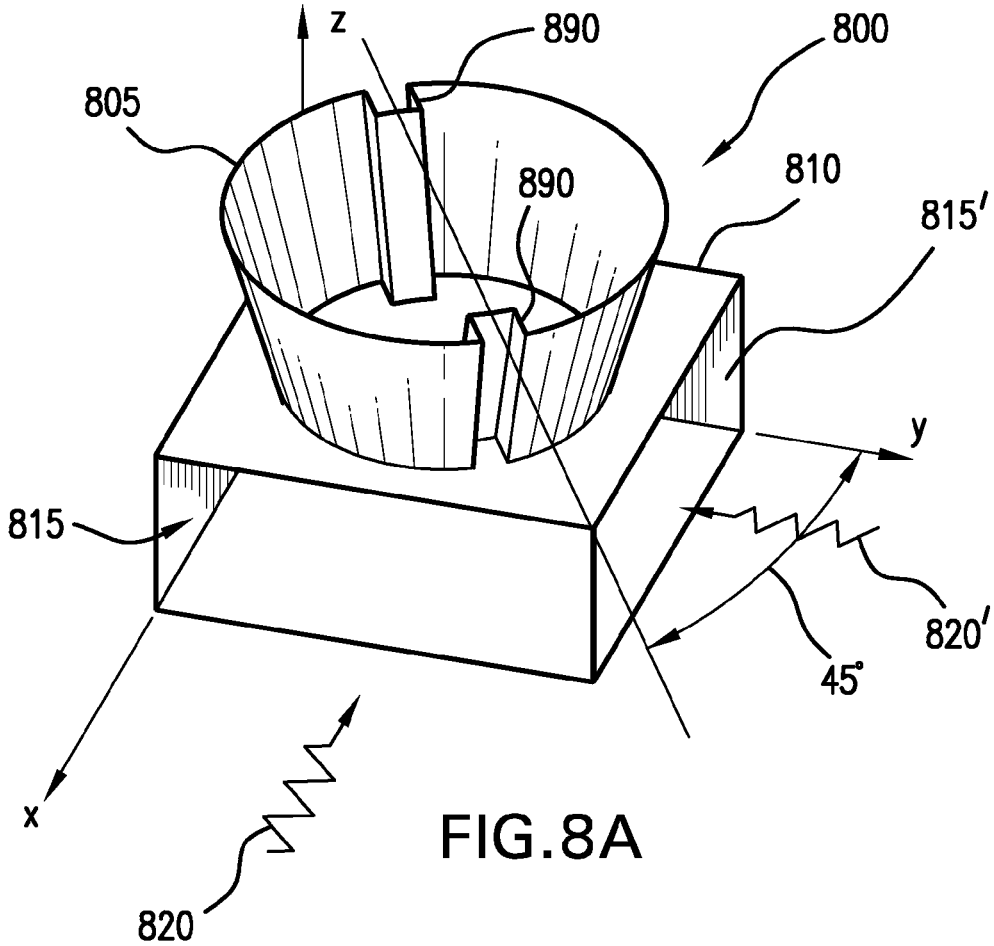
FIG. 8A depicts an embodiment of an antenna optimized for circularly polarized radiation.

FIG. 8A depicts an embodiment of an antenna 800 optimized for circularly polarized radiation. That is, when a planar wave 820 is fed to the waveguide 810, upon coupling to the radiating element 805 slots 890 would introduce a phase shift to the planar wave so as to introduce circular polarization so that the radiating wave would be circularly polarized. As shown, the slots 890 are provided at 45° alignments to the excitation port 815. Consequently, if a second planar wave, 820' is introduced via port 815', the radiating element 805 would produce two wave of orthogonal circular polarization.

Figure 8B:
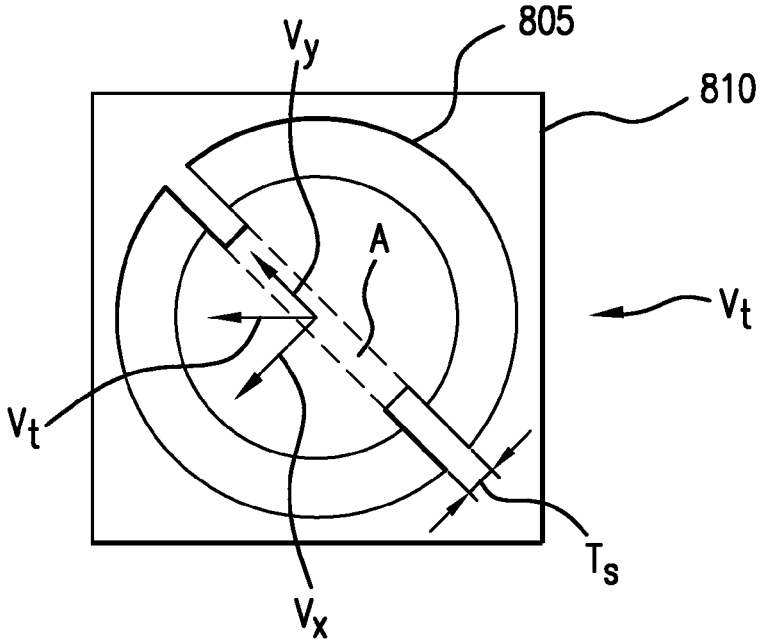
FIG. 8B is a top view of the embodiment of FIG. 8A.

FIG. 8B is a top view of the embodiment of FIG. 8A. As illustrated in FIG. 8B, for the purpose of generating a circular polarization field, the following polarization control scheme is presented. A planar wave is generated and caused to propagate in the waveguide's cavity, as shown by arrow Vt. A circular polarization is introduced to the planar wave by perturbing the cone element's fields and introducing a phase shift of 90 degrees between the two orthogonal E field components (e.g., the components that are parallel to the slot and the components that are perpendicular to the slot Vx, Vy). This creates a circularly polarized field. This is accomplished without effecting the operation of the array into which the circular polarization element is incorporated. It should be noted that in this example, the perturbation is in a 45 degree relationship to the polarized field that is propagating in the cavity just beneath the element.

Figure 8C:
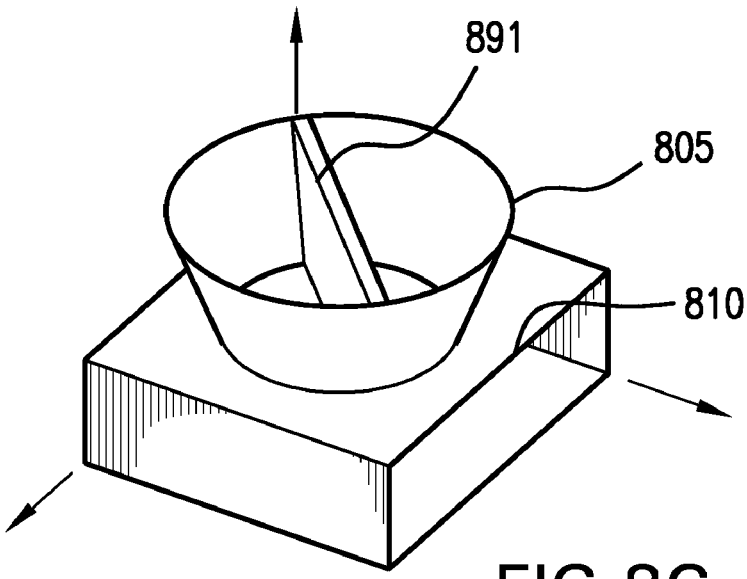
FIG. 8C depicts another embodiment of an antenna optimized for circularly polarized radiation.

In generating the slots, one should take into account the following. The thickness of the slot should be sufficiently large so as to cause the perturbation in the wave. It is recommended to be in the order of 0.05-0.1λ. The size of the slots and the area A delimited between them (marked with broken lines) should be such that the effective dielectric constant generated is higher than that of the remaining area of the radiating element, so that the component Vy propagates at a slower rate than the component Vx, to thereby provide a circularly polarized wave of Vx+jVy. Alternatively, one may achieve the increased dielectric constant by other means to obtain similar results. For example, FIG. 8C depicts another embodiment of an antenna optimized for circularly polarized radiation. In FIG. 8C, the radiating element 805 is a cone similar to that of the embodiment of FIG. 1A. However, to generate the circular polarization, a retarder 891 in the form of a piece of material, e.g. Teflon, having higher dielectric constant than air is inserted to occupy an area similar to that of the slots and area A of FIG. 8B.

Figure 8D:
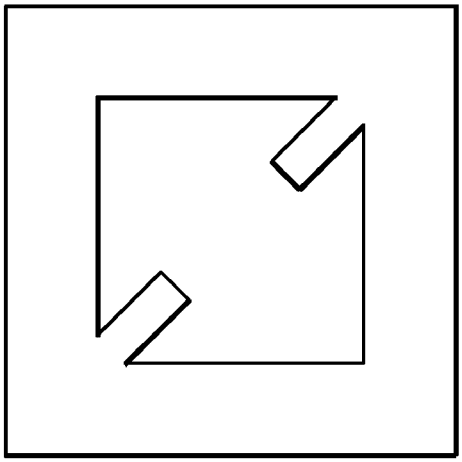
Figure 8E:
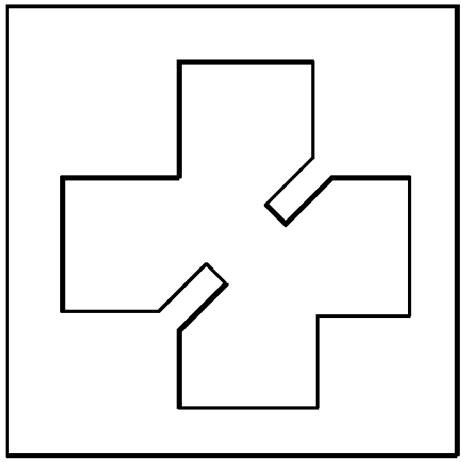
FIG. 8E illustrates a top view of a cross-shaped circularly polarizing radiating element.

The circularly-polarizing radiating element of the above embodiments may also be constructed of any other shape. For example, FIG. 8D illustrate a top view of a square circularly polarizing radiating element, while FIG. 8E illustrates a top view of a cross-shaped circularly polarizing radiating element.

Some advantages of this feature may include, without limitation: (1) an integrated polarizer; (2) cross polar discrimination (XPD) greater than 30 dB; (3) adaptability to a relatively flat antenna; (4) very low cost; (5) simple control; (6) wideband operation; and (6) the ability to be excited to generate simultaneous dual polarization. Some adaptations of this feature include, without limitation: (1) a technology platform for any planar antenna needing a circular polarization wideband field; (2) DBS fixed and mobile antennas; (3) VSAT antenna systems; and (4) fixed point-to-point and point-to-multipoint links.

Figure 9:
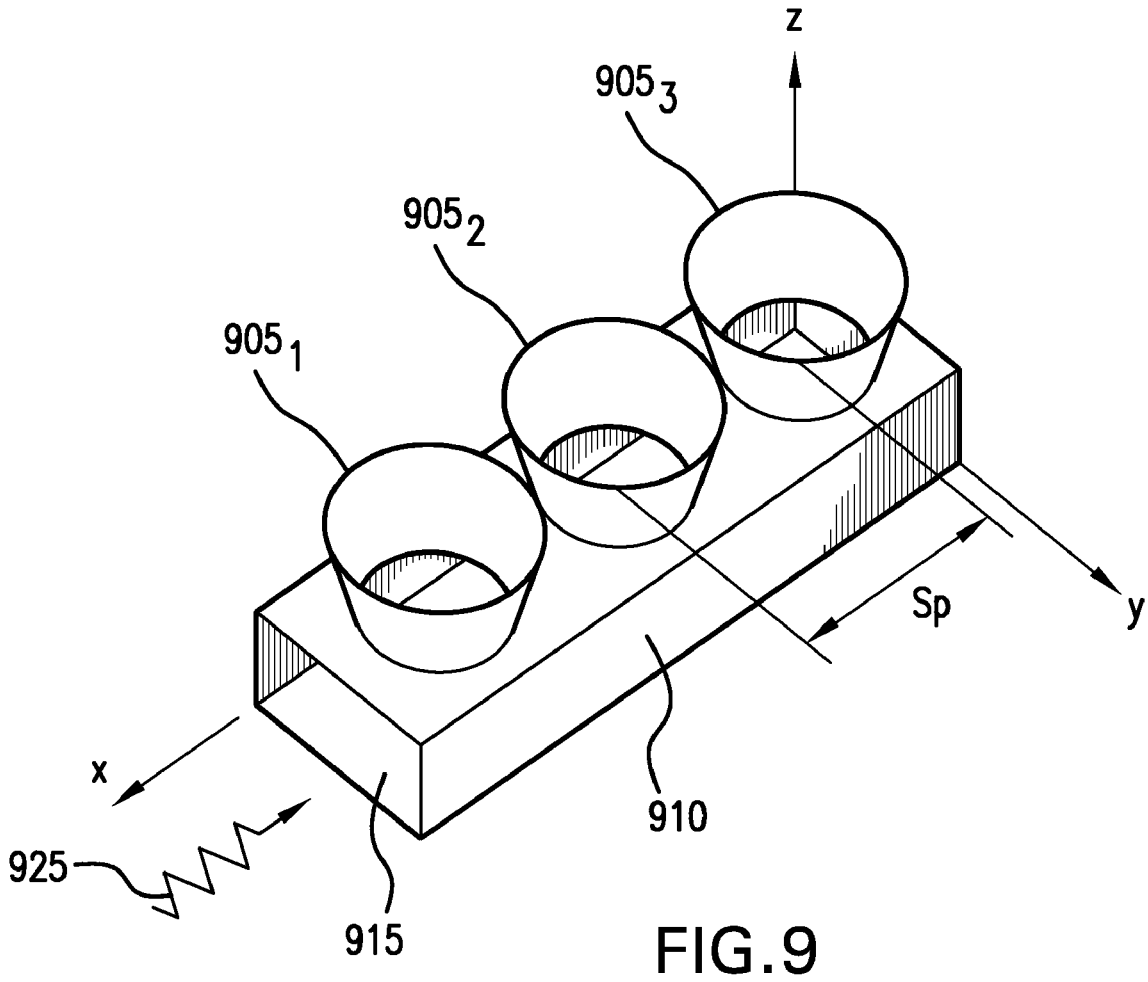
FIG. 9 illustrates a linear antenna array according to an embodiment of the invention.
Figure 10:
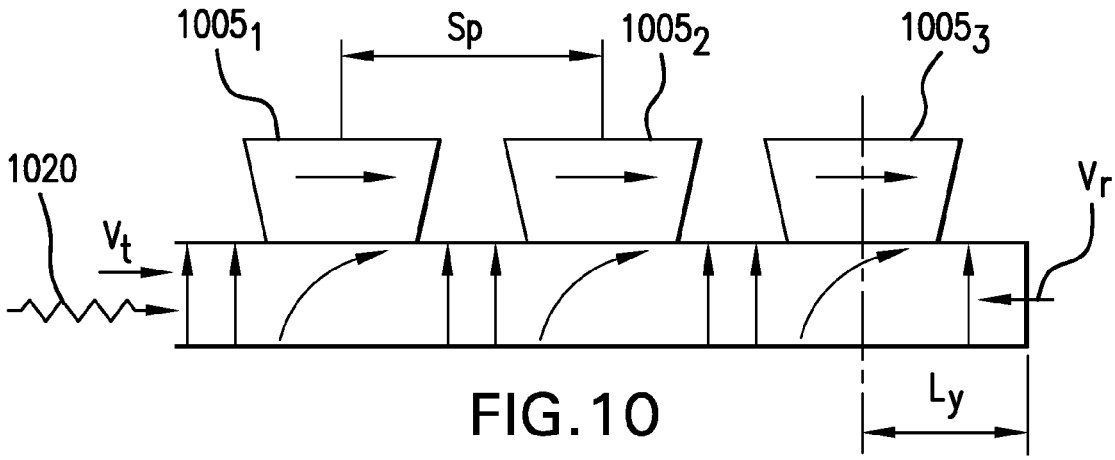
FIG. 10 provides a cross-section of the embodiment of FIG. 9.

FIG. 9 illustrates a linear antenna array according to an embodiment of the invention. In general, the linear array has 1×m radiating element, where in this example 1×3 array is shown. In FIG. 9 radiating elements $\mathbf{905}_1$, $\mathbf{905}_2$, and $\mathbf{905}_3$, are provided on a single waveguide 910. In this embodiment cone-shaped radiating elements are used, but any shape can be used, including any of the shapes disclosed above. FIG. 10 provides a cross-section of the embodiment of FIG. 9. As illustrated in FIG. 10, the wave 1020 propagates inside the cavity of waveguide 1010 in direction Vt, and part of its energy is coupled to each of the radiating elements as in the previous embodiments. The amount of energy coupled to each radiating element can be controlled by the geometry, as explained above with respect to a single element. Also, as explained above, the distance Ly from the back of the cavity to the last element in the array should be configured so that a reflective wave, if any, would be reflected in phase with the traveling wave. If each radiating element couples sufficient amount of energy so that no energy is left to reflect from the back of the cavity, then the resulting configuration provides a traveling wave. If, on the other hand, some energy remains and it is reflected in phase from the back of the cavity, a standing wave results.

The selection of spacing Sp between the elements enables introducing a tilt to the radiating beam. That is, if the spacing is chosen at about 0.9-1.0λ, then the beam direction is at boresight. However, the beam can be tilted by changing the spacing between the elements. For example, if the beam is to be scanned between 20° and 70° by using a scanning feed, it is beneficial to induce a static tilt of 45° by having the spacing set to about 0.5λ, so that the active scan of the feed is limited to 25° of each side of center. Moreover, by implementing such a tilt, the loss due to the scan is reduced. That is, the effective tilt angle can be larger than the tilt in the x and y components, according to the relationship $\theta_0=\mathrm{Sqrt}(\theta_x^2+\theta_y^2)$.

Figure 11:
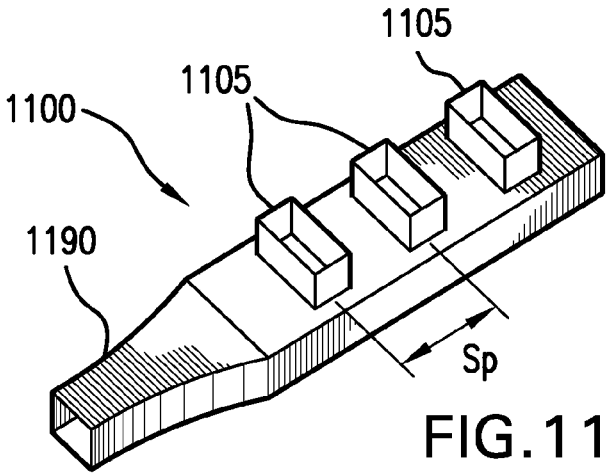
FIG. 11 illustrates a linear array fed by a sectorial horn as a source, according to an embodiment of the invention.

FIG. 11 illustrates a linear array 1100 fed by a sectoral horn 1190 as a source, according to an embodiment of the invention. In the embodiment shown, rectangular radiating elements 1105 are used, although other shapes may be used. Also, the feed is provided using an H-plan sectoral horn 1190, but other means may be used for wave feed. As before, the spacing Sp can be used to introduce a static tilt to the beam.

As can be understood from the embodiments of FIGS. 9, 10 and 11, a linear array may be constructed using radiating elements incorporating any of the shapes disclosed herein, such as conical, rectangular, cross-shaped, etc. The shape of the array elements may be chosen, at least in part, on the desired polarization characteristics, frequency, and radiation pattern of the antenna. The number, distribution and spacing of the elements may be chosen to construct an array having specific characteristics, as will be explained further below.

Figure 12A:
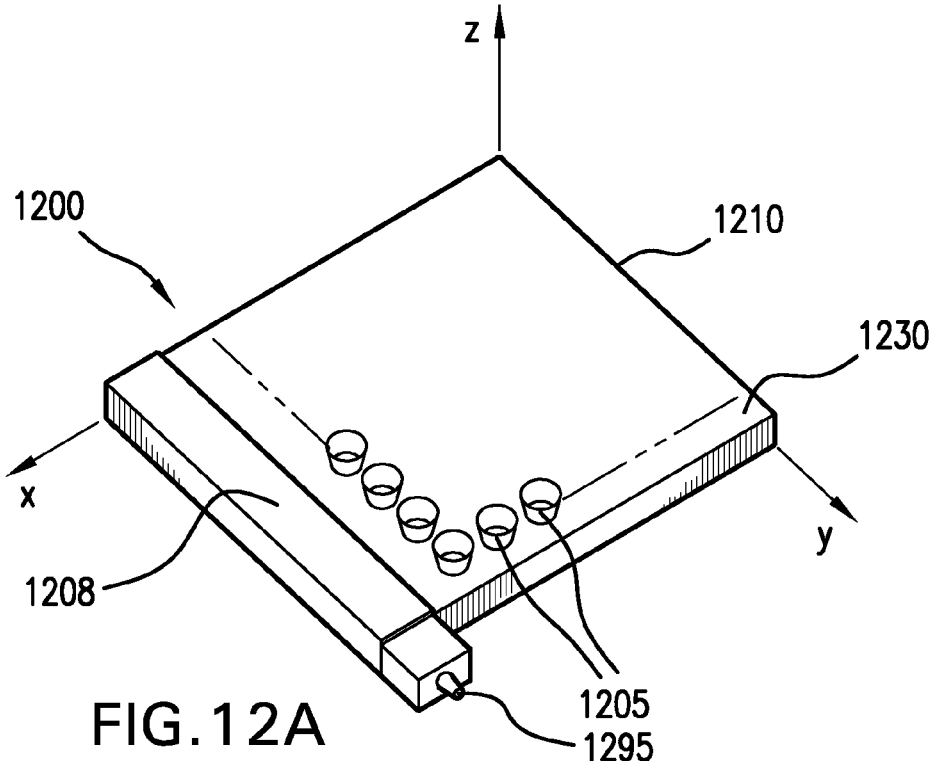
FIG. 12A illustrates an example of a two-dimensional array according to an embodiment of the invention

FIG. 12A illustrates an example of a two-dimensional array 1200 according to an embodiment of the invention. The array of FIG. 12A is constructed by a waveguide 1210 having an n×m radiating elements 1205. In the case that either n or m is set to 1, the resulting array is a linear array. As with the linear array, the radiating elements may be of any shape designed so as to provide the required performance. The array of FIG. 12A may be used for polarized radiation and may also be fed from two orthogonal directions to provide a cross-polarization, as explained above. Also, by providing proper feeding, beam steering and the generation of multiple simultaneous beams can be enabled, as will be explained below.

The example of the rectangular cone array antenna 1200 shown in FIG. 12A is a based on the use of a cone element 1205 as the basic component of the array. The antenna 1200 is being excited by a plane wave source 1208, which may be formed as a slotted waveguide array, microstrip, or any other feed, and having a feed coupler 1295 (e.g. coaxial connector). In this example, a slotted waveguide array feed is used and the slots on the feed 1208 (not shown), are situated on the wider dimension of the waveguide 1210, thus exciting a vertical polarized plane wave. The wave then propagates into the cavity, where on the top surface 1230 of the cavity the cone elements 1205 are situated on a rectangular grid of designed fixed spacing along the X and Y dimensions. As with the linear array, the spacing is calculated to either provide a boresignht radiation or tilted radiation. Each cone 1205 couple a portion of the energy of the propagating wave, and excite the upper aperture of the cone 1205, once the wave has reached all the cones in the array, each of the cones function as a source for the far field of the antenna. In the far field of the antenna, one gets a Pencil Beam radiation pattern, with a gain value that is proportional to the number of elements in the array, the spacing between them, and related to the amplitude and phase of their excitations. However, unlike the prior art, the wave energy is coupled to the array without the need to elaborate waveguide network. For example, in the prior art an array of 4×4 elements would require a waveguide network having 16 individual waveguides arranged in a manifold leading to the port. The feeding network is eliminating by coupling the wave energy directly from the cavity to the radiating elements.

Figure 12B:
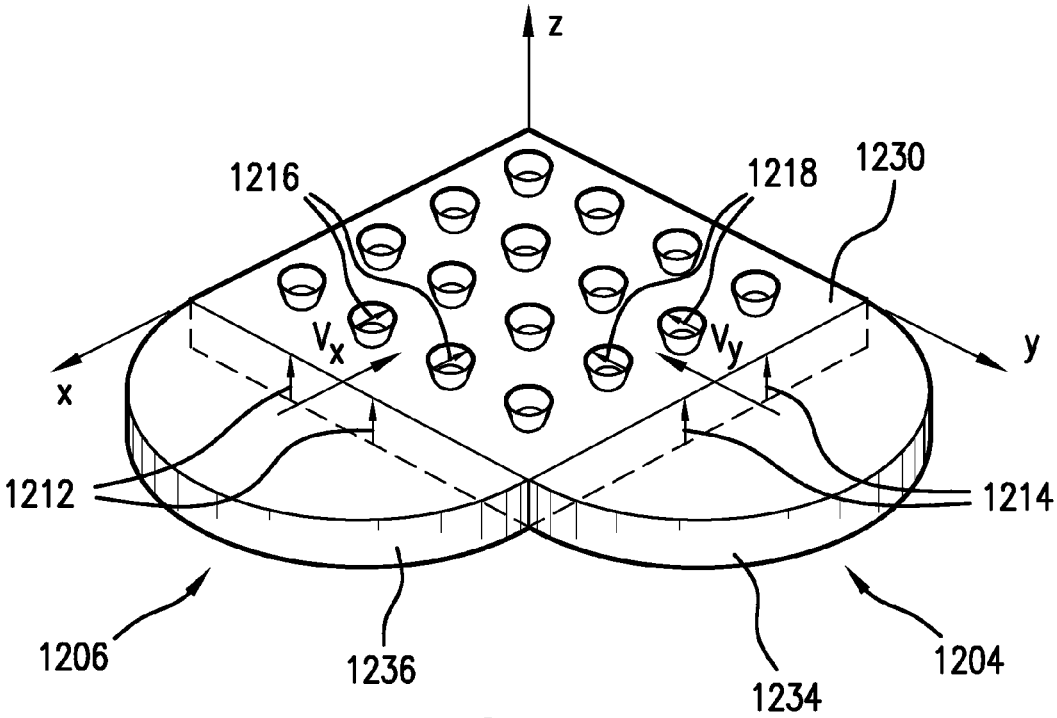
FIG. 12B illustrates a two-dimensional array according to another embodiment of the invention configured for operation with two sources.
Figure 12C:
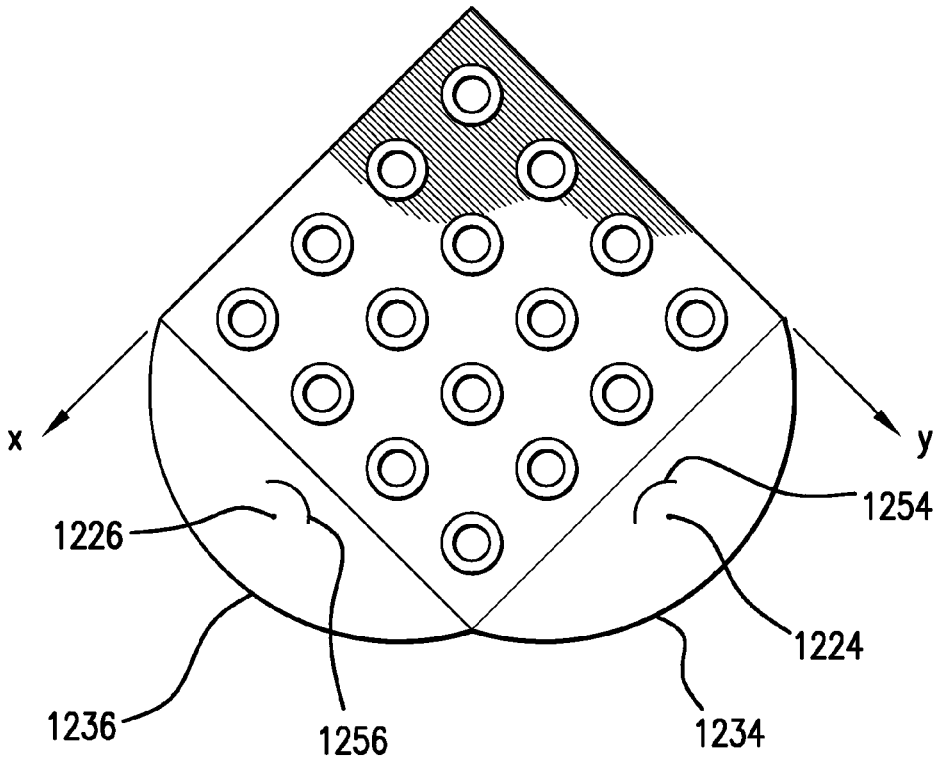
FIG. 12C is a top view of the array illustrated in FIG. 12B.

FIG. 12B illustrates a two-dimensional array according to another embodiment of the invention configured for operation with two sources. FIG. 12C is a top view of the array illustrated in FIG. 12B. The waveguide base and radiating elements are the same as in FIG. 12A, except that two faces of the waveguide are provided with sources 1204 and 1206. In this particular example a novel pin radiation source with a reflector is shown, but other sources may be used. In this example, source 1204 radiates a wave having vertical polarization, as exemplified by arrows 1214. Upon coupling to the radiation elements 1205 the wave assumes a horizontal polarization in the Y direction, as exemplified by arrows 1218. On the other hand, source 1206 radiates a planar wave, which is also vertically polarized, however upon coupling to the radiating elements assumes a horizontal polarization in the X direction. Consequently, the antenna array of FIG. 12B can operate at two cross polarization radiations. Moreover, each source 1204 and 1206 may operate at different frequency.

Each of sources 1204 and 1206 is constructed of a pin source 1224 and 1226 and a curved reflector 1234 and 1236. The curve of the reflectors is designed to provide the required planar wave to propagate into the cavity of the waveguide. Focusing reflectors 1254 and 1256 are provided to focus the transmission from the pins 1204 and 1206 towards the curved reflectors 1234 and 1236.

The embodiments described above use a rectilinear waveguide base. However, as noted above, other shapes may be used. For example, according to a feature of the invention, a circular array antenna can be constructed using a circular waveguide base and radiating elements of any of the shapes disclosed herein. The circular array antenna may also be characterized as a "flat reflector antenna." To date, high antenna efficiency has not been provided in a 2-D structure. High efficiencies can presently only be achieved in offset reflector antennas (which are 3-D structures). The 3-D structures are bulky and also only provide limited beam scanning capabilities. Other technologies such as phased arrays or 2-D mechanical scanning antennas are typically large and expensive, and have low reliability.

The circular array antenna described herein provides a low-cost, easily manufactured antenna, which enables built-in scanning capabilities over a wide range of scanning angles. Accordingly, a circular cavity waveguide antenna is provided having high aperture efficiency by enabling propagation of electromagnetic energy through air within the antenna elements (the cross sections of which can be cones, crosses, rectangles, other polygons, etc.). The elements are situated and arranged on the constant phase curves of the propagating wave. In the case of a cylindrical cavity reflector, the elements are arranged on pseudo arcs. By controlling the cavity back wall cross-section function (parabolic shape or other), the curves can transform to straight lines, thus providing the realization of a rectangular grid arrangement. The structure may be fed by a cylindrical pin (e.g., monopole type) source that generates a cylindrical wave. For one example the cones couple the energy at each point along the constant phase curves, and by carefully controlling the cone radii and height, one can control the amount of energy coupled, changing both the phase and amplitude of the field at the aperture of the cone. Similar mechanism can be applied to any shape of element.

Figure 13:
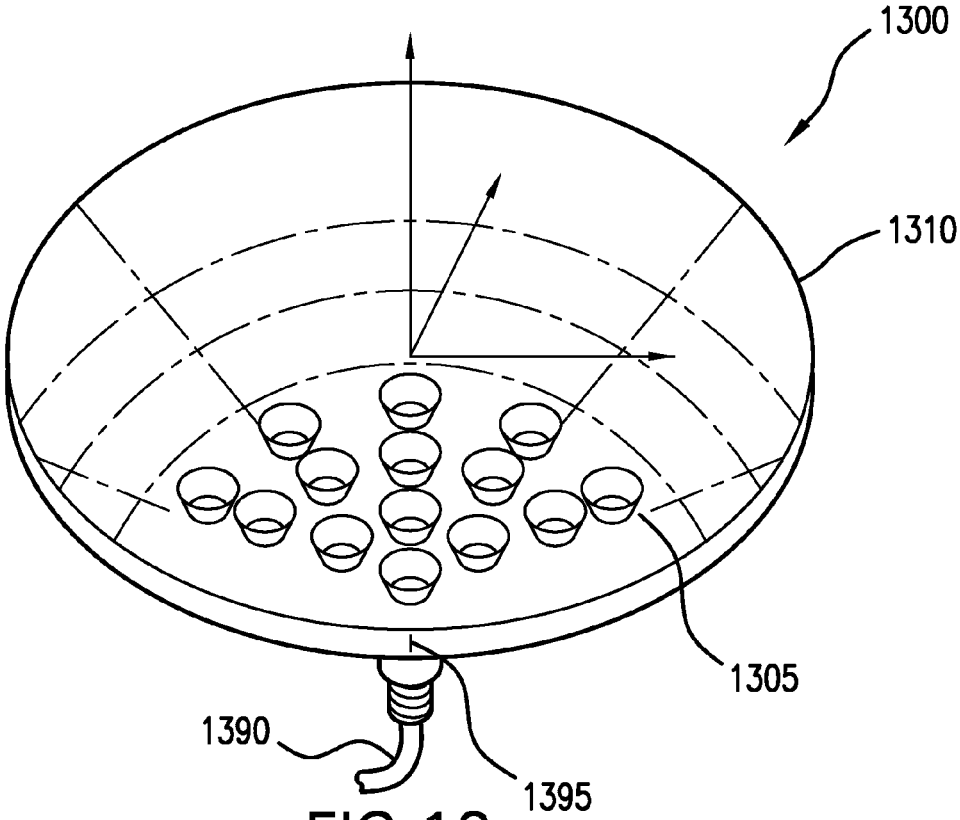
FIG. 13 illustrates and example of a circular array antenna according to an embodiment of the invention.

FIG. 13 illustrates and example of a circular array antenna 1300 according to an embodiment of the invention. As shown, the base of the antenna is a circularly-shaped waveguide 1310. A plurality of radiating elements 1305 are arranged on top of the waveguide. In this example, the cone-shaped radiating elements are used, but other shapes may also be used, including the circular-polarization inducing elements. The radiating elements 1305 are arranged in arcs about a central axis. The shape of the arcs depends on the feed and the desired characteristics of radiation. In this embodiment the antenna is fed by an omni-directional feed, in this case a single metallic pin 1395 placed at the edge of the plate, which is energize by a coaxial cable 1390, e.g. a 50'Ω coaxial line. This feed generates a cylindrical wave that propagates inside the cavity. The radiating elements 1305 are arranged along fixed-phase arcs so as to couple the energy of the wave and radiate it to the air. Since the wave in the waveguide propagates in free space and is coupled directly to the radiating elements, there is very little insertion loss. Also, since the wave is confined to the circular cavity, most of the energy can be used for radiation if the elements are carefully placed. This enables high gain and high efficiency of the antenna well in excess of that achieved by other flat antenna embodiments and offset reflector antennas.

Figure 14:
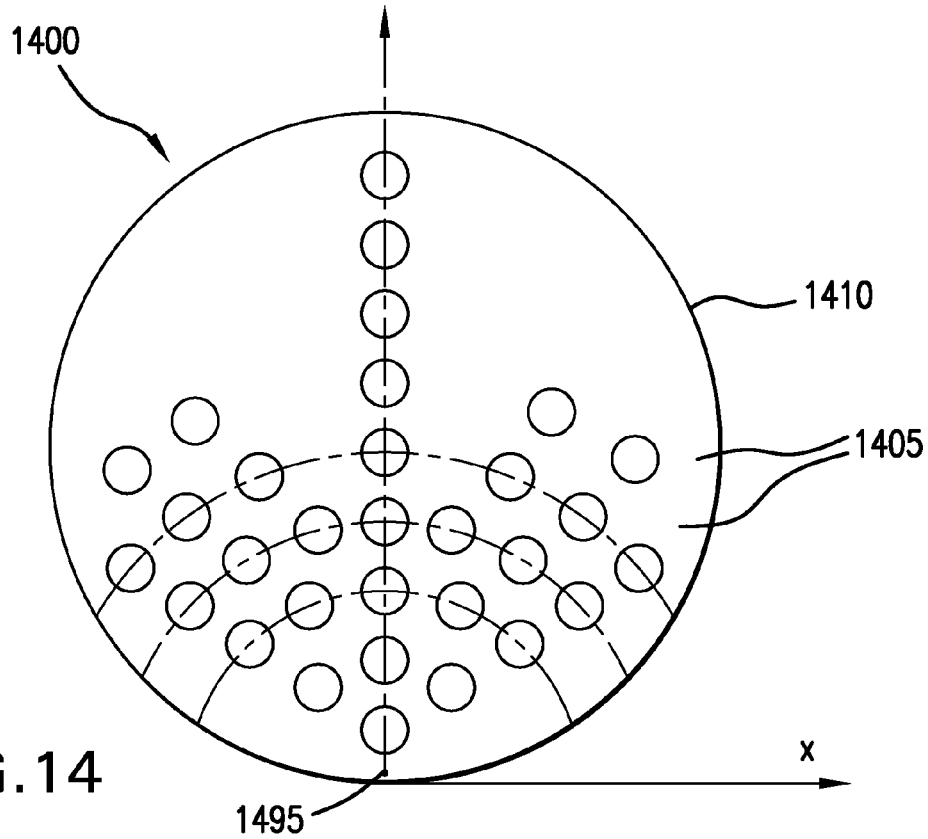
FIG. 14 is a top view of another embodiment of a circular array antenna of the invention.

FIG. 14 is a top view of another embodiment of a circular array antenna 1400 of the invention. This embodiment also uses a circular waveguide 1410, but the radiating elements 1405 are arranged in different shape arcs, which are symmetrical about the central axis. The feed may also be in the form of a pin 1495 provided at the edge of the axis, defining the boresight.

According to a feature of the invention, the various array antennas can enable beam scanning. For example, in order to scan the beam of a circular waveguide the source can be placed in different angular locations along the circumference of the circular cavity, thus creating a phase distribution along previously constant phase curves. At each curve there will be a linear phase distribution in both the X and Y directions, which in turn will tilt the beam in the Theta and Phi directions. This achieves an efficient thin, low-cost, built-in scanning antenna array. Arranging a set of feeds located on an arc enables a multi-beam antenna configuration, which simplifies beam scanning without the need for typical phase shifters.

Some advantages of this aspect of the invention may include, without limitation: (1) a 2-D structure which is flat and thin; (2) extremely low cost and low mechanical tolerances fit for mass production; (3) built-in reflector and feed arrangement, which enables wide-beam scanning without the need for expensive phase shifters or complicated feeding networks; (4) scalable to any frequency; (5) can work in multi-frequency operation such as two-way or one-way applications; (6) can accommodate high-power applications. Some associated applications may include, without limitation: (1) one-way DBS mobile or fixed antenna system; (2) two-way mobile IP antenna system (3) mobile, fixed, and/or military SATCOM applications; (4) point-to-point or point-to-multipoint high frequency (up to approximately 100 GHz) band systems; (5) antennas for cellular base stations; (6) radar systems.

Figure 15:
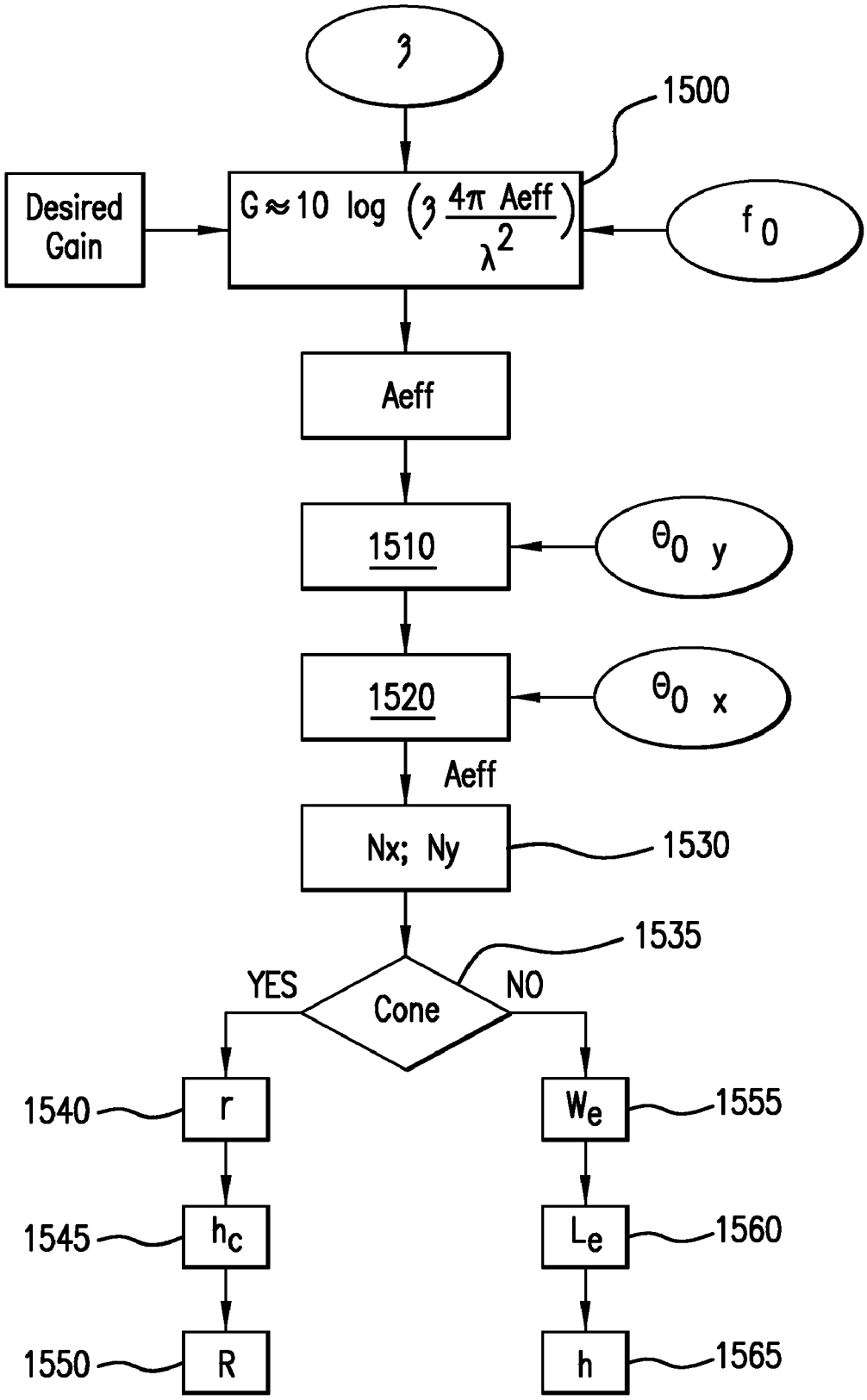
FIG. 15 illustrates a process of designing a Cartesian coordinate array according to an embodiment of the invention.

FIG. 15 illustrates a process of designing an array according to an embodiment of the invention. In step 1500 the parameters desired gain, G, efficiency, $\zeta$, and frequency, $f_0$, are provided as input into the gain equation to obtain the required effective area Aeff. Then in steps 1510 and 1520 the desired static tilt angles ($\theta_0x$, $\theta_0y$) of the beam along y and x direction are provide as input, so as to determine the spacing of the elements along the x and y directions (see description relating to FIG. 10). By introducing static tilt in x and y direction, the beam can be statically tilted to any direction in (r,θ) space. Using the area and the spacing, one obtains the number of elements (Nx, Ny) in the x and y directions in step 1530. Then, at Step 1535 if the radiating element chosen is circular, the lower radius is determined at Step 1540, i.e., the radius of the coupling aperture, and using the height determined at Step 1545 (e.g., 0.3λ) the upper radius, i.e., the radiating aperture, is generated at Step 1550. On the other hand, if at Step 1535 a polygon cross section is selected, at steps 1555 and 1560 the lower width and length of the element, i.e., the area of the coupling aperture, are determined. Then the height is selected based on the wavelength at step 1565. If flare is desired, the upper width and length may be tuned to obtain the proper characteristics as desired.

According to a method of construction of the antennas and arrays of the various embodiments described herein, a rectangular metal waveguide is used as the base for the antenna. The radiating element(s) may be formed by extrusion on a side of the waveguide. Each radiating element may be open at its top to provide the radiating aperture and at the bottom to provide the coupling aperture, while the sides of the element comprise metal extruded from the waveguide. Energy traveling within the waveguide is radiated through the element and outwardly from the element through the open top of the element. This method of manufacture is simple compared with other antennas and the size and shape of the element(s) can be controlled to achieve the desired antenna characteristics such as gain, polarization, and radiation pattern requirements.

According to another method, the entire waveguide-radiating element(s) structure is made of plastic using any conventional plastic fabrication technique, and is then coated with metal. In this way a simple manufacturing technique provides an inexpensive and light antenna.

An advantage of the array design is the relatively high efficiency (up to about 80-90% efficiency in certain situations) of the resulting antenna. The waves propagate through free space and the extruded elements do not require great precision in the manufacturing process. Thus the antenna costs are relatively low. Unlike prior art structures, the radiating elements of the subject invention need not be resonant thus their dimensions and tolerances may be relaxed. Also, the open waveguide elements allow for wide bandwidth and the antenna may be adapted to a wide range of frequencies. The resulting antenna may be particularly well-suited for high-frequency operation. Further, the resulting antenna has the capability for an end-fire design, thus enabling a very efficient performance for low-elevation beam peaks.

A number of wave sources may be incorporated into any of the embodiments of the inventive antenna. For example, a linear phased array micro-strip antenna may be incorporated. In this manner, the phase of the planar wave exciting the radiating array can be controlled, and thus the main beam orientation of the antenna may be changed accordingly. In another example, a linear passive switched Butler matrix array antenna may be incorporated. In this manner, a passive linear phased array may be constructed using Butler matrix technology. The different beams may be generated by switching between different inputs to the Butler matrix. In another example a planar waveguide reflector antenna may be used. This feed may have multi-feed points arranged about the focal point of the planar reflector to control the beam scan of the antenna. The multi-feed points can be arranged to correspond to the satellites selected for reception in a stationary or mobile DBS system. According to this example, the reflector may have a parabolic curve design to provide a cavity confined structure. In each of these cases, one-dimensional beam steering is achieved (e.g., elevation) while the other dimension (e.g., azimuth beam steering) is realized by rotation of the antenna, if required.

Turning to RF feeds or sources, the subject invention provides advantageous feed mechanisms that may be used in conjunction with the various inventive radiating elements described herein, or in conjunction with a conventional antenna using, e.g., micro-strip array, slotted cavity, or any other conventional radiating elements. Since the type of radiating elements used in conjunction with the innovative feed mechanism is not material, the radiating elements will not be explicitly illustrated in some of the figures relating to the feed mechanism, but rather "x" marks will be used instead to illustrate their presence.

Figure 16:
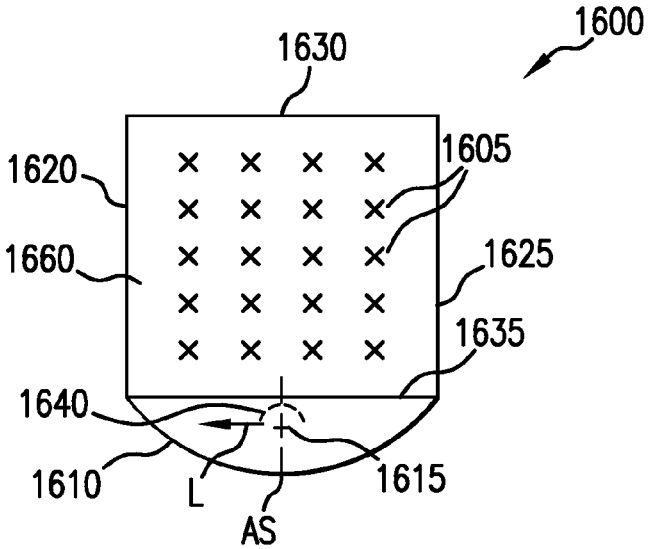
FIGS. 16 and 16A-16E illustrate embodiments of an RF Source reflector feed for planer wave in near field regime of the electromagnetic field, according to the invention.

FIG. 16 illustrates an embodiment of an RF feed according to an embodiment of the invention. In FIG. 16 a two dimensional array antenna 1600 is bounded at sides 1620, 1625, and 1630, to define cavity 1660, which receives radiation from side 1635. Antenna 1600 has a plurality of radiating elements 1605, the location of each of which is generally indicates by "x", which may be of any conventional type, or of any of the inventive radiating elements described herein. The embodiment of FIG. 16 illustrates a single point feed arrangement, so it has a single radiating source and a single beam. In this example, radiation pin 1615 is provided in the area between open (feed) side 1635 and reflector 1610. The radiating pin 1615 radiates energy so as to generate a planar wave front at the entry face 1635 to the cavity 1660, propagating in a direction and with phase and amplitude distribution that is according to the design of the reflector 1610 and the location of the pin. When the pin is situated along the axis of symmetry, AS, the radiation direction is boresight, as shown in FIG. 16. If the pin is moved to the left along arrow L, the beam would tilt to the right and, conversely, if the pin is moved to the right the beam would tilt to the left. That is, beam tilt may be controlled by the location of the radiating pin. Thus, for example, by mechanically moving the radiating pin, one can control the beam tilt.

Figure 16A:
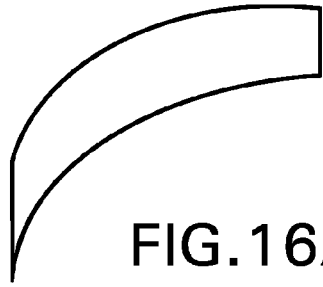
Figure 16B:
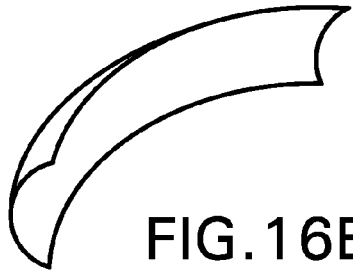

The reflector 1610 is made of an RF reflective material, such as metal or plastic coated with metallic layer, and is designed as a function f(x,y) so as to generate the desired beam shape, i.e., aperture, which includes amplitude and phase. FIG. 16A illustrate a reflector that may follow a parabolic or cylindrical function, while FIG. 16B illustrates a reflector that follows a 3-dimensional, toroidal shape. Additionally, in FIG. 16 an optional counter reflector 1640 is used so as to have the radiation from the pin reflected back towards the reflector 1610, generating a focusing effect. While the counter reflector is not necessary, it provides an improved performance.

Figure 16C:
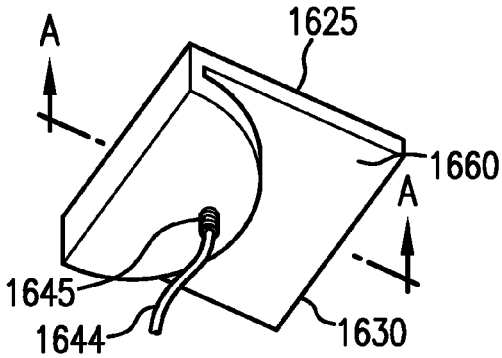
Figure 16D:
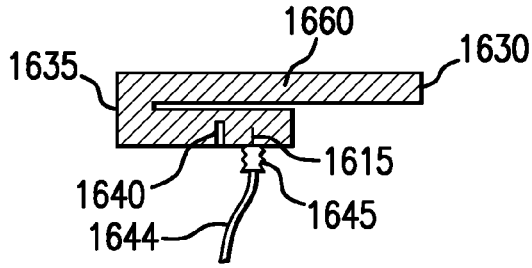

In FIG. 16, the reflector 1610 is shown extending from one side of the antenna. However, in order to reduce the "footprint" of the antenna, the feeding-reflector arrangement may be "folded" under the antenna. An example is illustrated in FIGS. 16C and 16D. FIG. 16C illustrate a perspective view from under the antenna, showing the folded feed-reflector arrangement, while FIG. 16D illustrate a cross-section along line A-A of FIG. 16C. In FIGS. 16C and 16D, the feed coupler, e.g., a coaxial connector 1645, is provided from the bottom of the antenna to deliver/collect RF power to/from the radiating pin 1615 to the transmission line, e.g., coaxial cable 1644. This arrangement provides the same radiation characteristics as that of FIG. 16, except that the total area of the device is reduced.

Figure 16E:
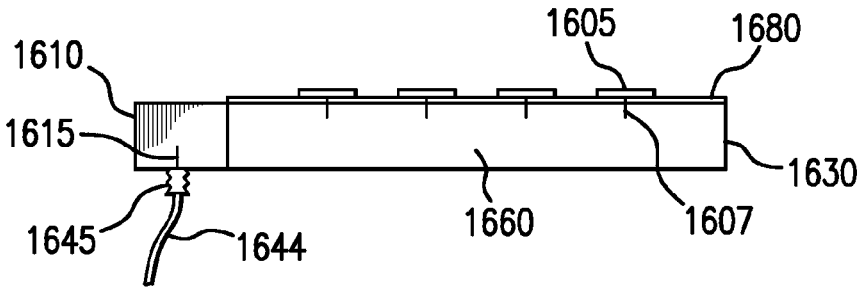

FIG. 16E illustrates an embodiment of the innovative reflector feed used in conjunction with a patch array. In FIG. 16E the RF cavity 1660 is similar to that of FIG. 16, and similarly has end wall 1630 opposite the curved reflector 1610. A radiation source, such as radiating pin 1615 is coupled to a transmission line, e.g., coaxial cable, 1644 via coupler 1645. The top part of the cavity 1660 is covered with an insulator 1680. Conductive patches 1605 are provided on top of the insulator 1680, serving as radiating elements.

Energy from the cavity 1660 is coupled to the radiating patches via conductive pins 1607 extending from each patch into the cavity 1660.

Figure 17:
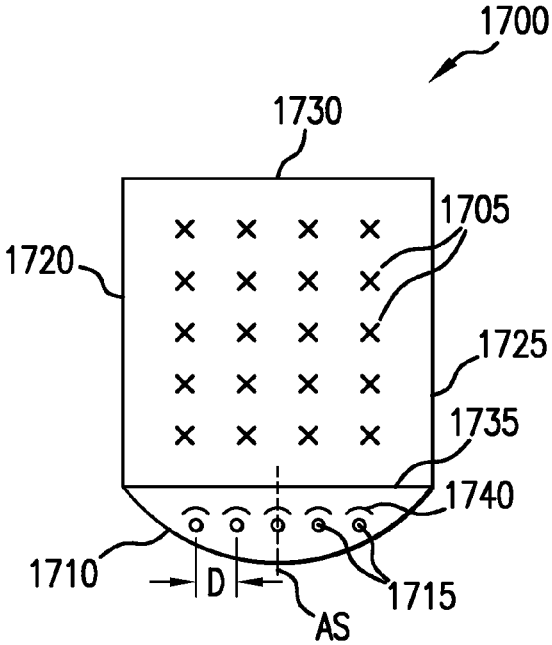
FIG. 17 illustrate another embodiment of an RF feed that includes several different collection pins, which corresponds to different beam locations (MultiBeam feed arrangement)

FIG. 17 illustrates an embodiment of an RF feed 1700 that is similar to that of FIG. 16, except that multiple RF radiation pins 1715 are used. Unless explicitly indicated otherwise, elements in FIG. 17 that are similar to those in FIG. 16 are reference by the same reference number, except being in the 17xx format rather than 16xx format. The absolute location of each pin determines the beam tilt generated by radiation from that pin. Thus for each pin location there is a distinct beam location in space. In the rectangular grid embodiment of FIG. 17, each pin location will scan the beam in a plane that is parallel to the axis upon which the pins are arranged. Therefore, if the pins are energized serially, one obtains a beam scan in the direction between sides 1720 and 1725. On the other hand, one may energize all of the pins simultaneously, resulting in the following. If the amplitude and phase distribution is equal to all pins, multiple beams are radiated, with lower gain on each beam since the energy is split among the pins. Consequently, the radiation pattern will look like a set of hills and valleys, with gain at the peaks equal to the gain of one beam less 10log (number of pins excited). According to another embodiment, one main beam pin is used in conjunction with two or more very close side pins, so as to shape the main beam. This is termed beam shaping. In one embodiment the energy to the adjacent beams is weighted, thereby improving the beam slop and thus improving interference satellite rejection or any other needed rejection, or shape the beam to a desired shape. In yet a further embodiment, one or more pins are fed at any given time, each pin corresponding to one beam tilted at a designed angle so as to point to a particular location in the sky, i.e., each pin corresponding to one satellite in the sky.

Figure 18:
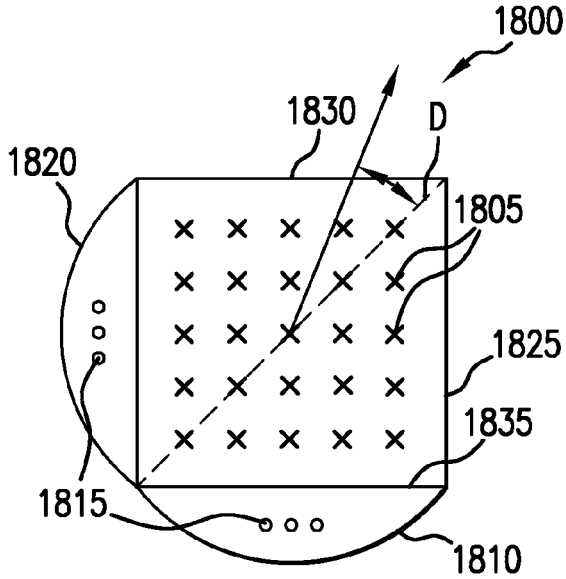
FIG. 18 illustrates an embodiment having dual-feed arrangement, for the benefit of generating dual polarization, multiple beam antenna. The Two orthogonal feeds each excites the array from a different face and thus generates dual orthogonal polarizations.

FIG. 18 illustrates an embodiment 1800 having dual-feed arrangement. Unless explicitly indicated otherwise, elements in FIG. 18 that are similar to those in FIG. 17 are reference by the same reference number, except being in the 18xx format rather than 17xx format. In FIG. 18 two reflectors 1810 and 1820 are used to provide dual polarization radiation into the cavity of array elements 1805. The resulting beam is therefore scanned along the diagonal D as illustrated. When one side is fed horizontal polarization and the other vertical polarization, one may generate circularly polarized radiation.

Figure 19:
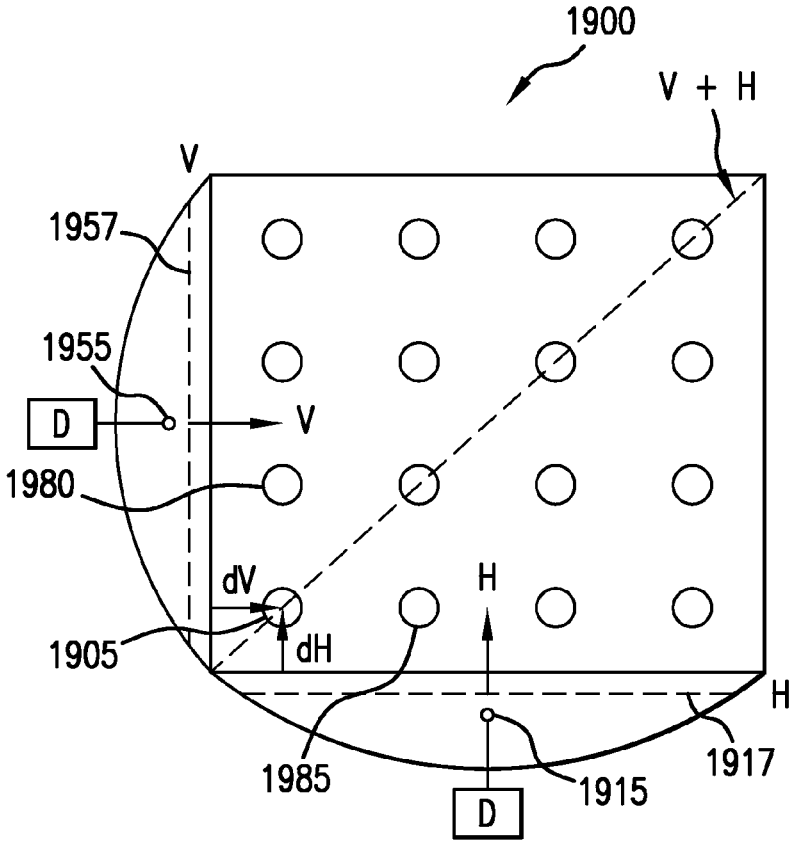
FIG. 19 illustrates the principle of beam tilt/scanning over the diagonal of a symmetrical array, with dual polarization capabilities.

FIG. 19 illustrates the principle of beam tilt/scanning over the diagonal of a symmetrical array 1900. In this example, radiating pin 1915 generates a plane wave 1917 of horizontal polarization, which propagates into the array as shown by arrow H. Radiating pin 1955 generates a plane wave 1957 of vertical polarization, which propagates into the array as shown by arrow V. To generate circular polarization, a 90 degrees phase is introduce between the horizontal and vertical polarized waves. This is done prior to feeding the pins 1915 and 1955 by, for example, using a hybrid or other electrical element illustrated generically as D. In this manner, the wave fronts arriving from the directions H and V at any element 1905 of the diagonal traverse the same distance $d_v=d_H$, and are therefore summed up over the diagonal V+H. Similarly, wave fronts arriving at elements that are placed symmetrically about the diagonal are also summed up due to the symmetry. For example, the distance traveled by wavefront V to element 1980 is $d_v$, while for wavefront H the distance is $2d_H$. Similarly, the distance traveled by wave front V to element 1985 is $2d_v$, while for wavefront H the distance is $d_H$. Now, since $d_v=d_H$, the radiation from these two elements would sum up. Note that for proper operation of this embodiment 1900, the radiating elements should have a symmetrical geometry, e.g., circular or square, and their distribution over the array should be symmetrical about the diagonal.

Figure 20A:
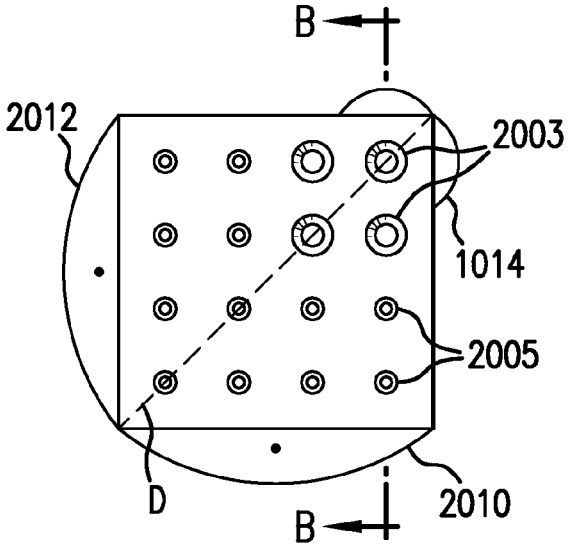
FIGS. 20A-20C illustrate an embodiment wherein the inventive reflector feed is utilized for an array operating in two frequencies of different bands. This is the mixed array concept which employs two set of elements, one for each band, where the high band elements are in frequency cutoff for the lower frequency band, and situated in two square array formation. The smaller square array formation on the upper right hand corner is being fed at the lower frequency and its elements can support the higher band as well.
Figure 20B:
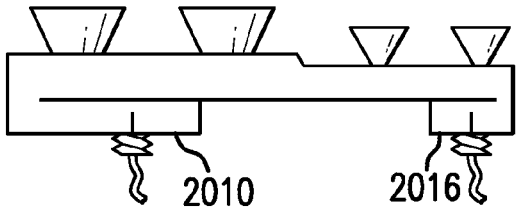

FIGS. 20A and 20B illustrate an embodiment wherein the inventive reflector feed is utilized for an array operating in two frequencies of different bands. Notably, this array can simultaneously operate at two frequencies that are vastly different, for example one at Ka band, while another at Ku band. In this embodiment, radiating elements 2005 are optimized to operate at one frequency, e.g., at Ka band, while radiating elements 2003 are optimized to operate at the other frequency, e.g., at Ku band. The radiating elements 2005 form one array that is symmetrical about diagonal D, and the radiating elements 2003 form a second array also symmetrical about diagonal D. The radiating elements 2005 are fed from reflector feeds 2010 and 2012, while radiating elements 2003 are fed from reflector feed 2014 and 2016. It should be appreciated that in the cross-section image of FIG. 20B the reflector feeds are folded, while in the top elevation of FIG. 20A the reflectors are not folded.

Figure 20C:
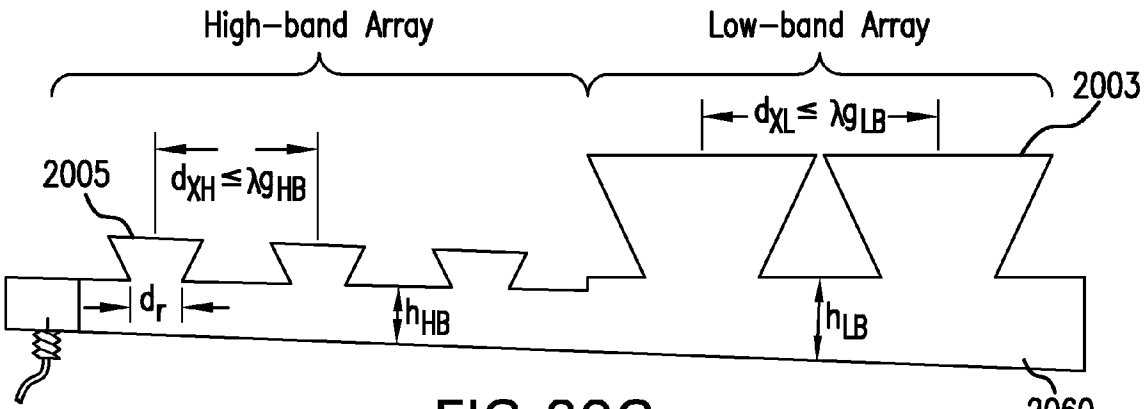

FIG. 20C is a basic cross section of the unit cell of the mixed array concept, according to an embodiment of the invention. In forming the array according to this embodiment, the higher band elements 2005 are designed first, so as to have the ability to couple the high band energy propagating inside the waveguide structure 2060. The lower diameter of elements 2005 presents frequency cutoff conditions, basically filtering the low frequency energy that propagates inside cavity 2060 without interruption or coupling to elements 2005. At the other section of the array, where the low band cones 2003 are situated, the low band elements can couple and support both the high and low frequency bands, and couple the energy for both bands, thus enabling the use of the whole area for the higher band, and the use of only the lower frequency array for the lower band.

In the design of the embodiment of FIG. 20C, the height $h_{HB}$ of the cavity 2060 at the area where the high band elements are provided is designed for the frequency at the high band, while the height $h_{LB}$ of the cavity 2060 is higher and designed according to the frequency of the low band. Also, the distance between elements, $dx_{HB}$ is designed to be equal or lower than the high band wavelength $\lambda g_{HB}$, while the length $dx_{LB}$ is designed to be equal or lower than the low band wavelength $\lambda g_{LB}$, wherein $\lambda g$ corresponds to the wavelength $\lambda_0$ as transformed in the cavity 2060. The diameter $d_r$, of the opening of the high band cones 2005 are designed to present a short for the wavelength of the low band, thereby operating as a cutoff or filter.

Using the design of FIG. 20C, both high band array and low band array are square arrays that can produce a standard radiation pattern. The low frequency band gain and radiation patterns are governed only by the low frequency band array, but the high band gain and radiation pattern and frequency beam scanning is governed by both the high band and low band arrays and is weighted by controlling the spacing and cone size on both the high and low band arrays. In fact by doing so we mitigate the frequency scanning effects on the high band.

Figure 20E:
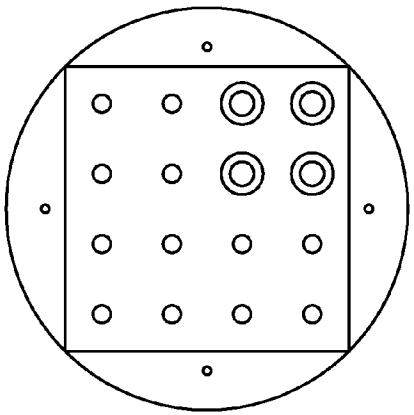
FIGS. 20D and 20E illustrate variations for the reflector feeds for the mixed array concept.
Figure 20D:
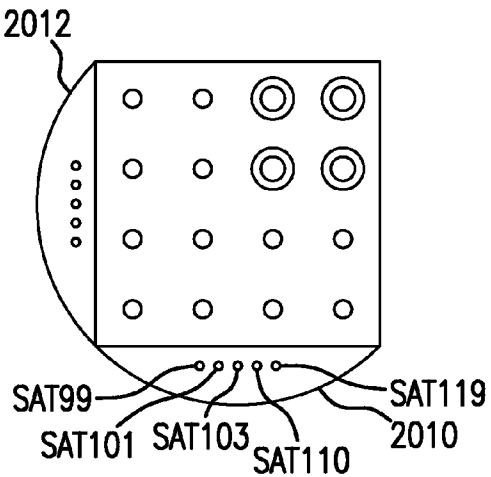
Figure 20F:
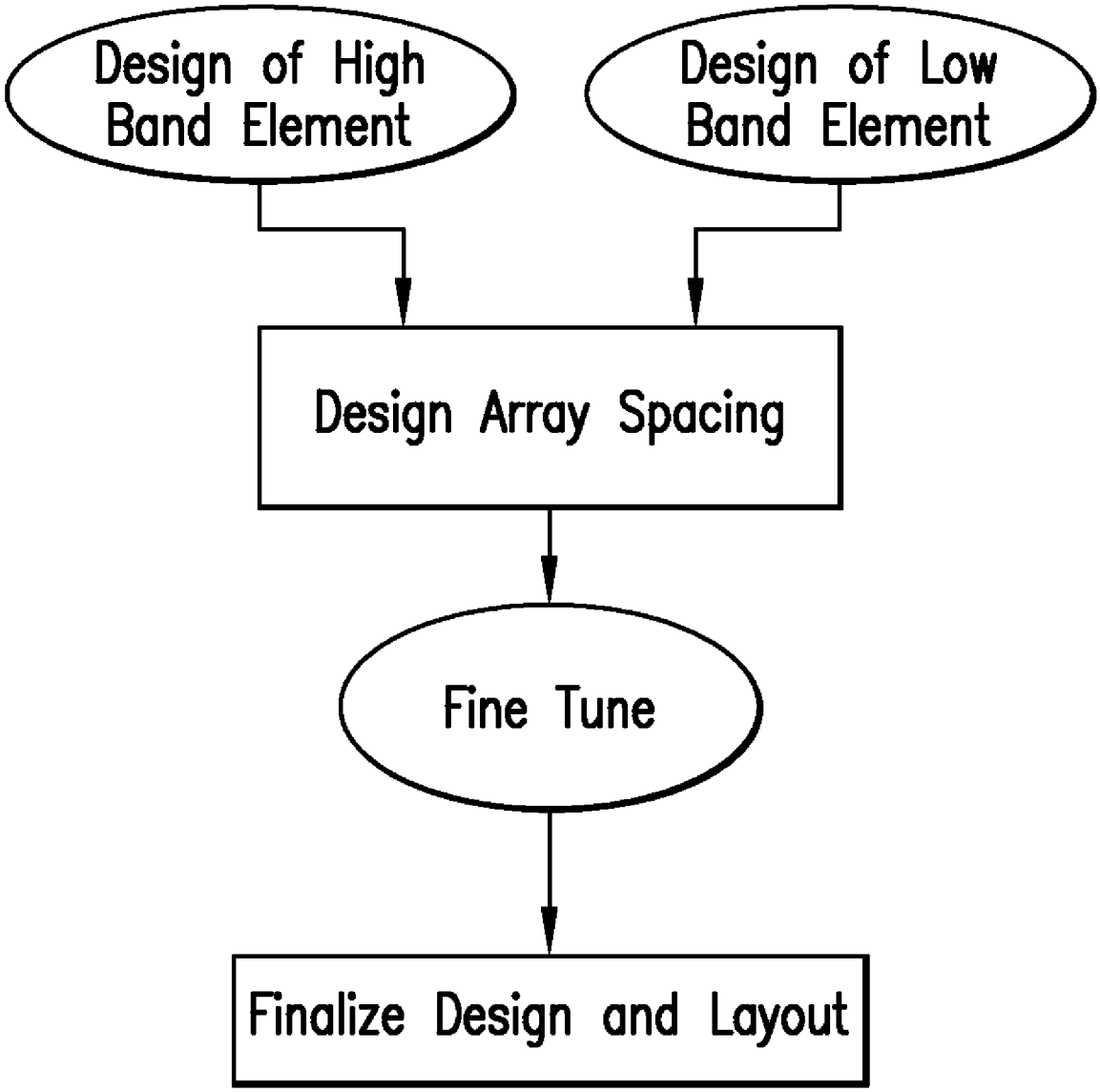
FIG. 20F illustrates a flow chart for the design of a mixed array antenna.

In addition, the feeds can be either situated along all four faces of the array, or situated just as two feeds, and the low and high Band collection points can be located at the same side of the array or spread between a four feed arrangements. FIGS. 20D and 20E illustrate variations for the reflector feeds for the mixed array concept. In FIG. 20D the feed for both the high band and low band is done from the same side, i.e., reflector feed 2010 is used for both high and low bands for one polarization, while reflector feed 2012 is used for both high and low bands for the other polarization. On the other hand, FIG.

20E illustrate symmetrical reflector feeding arrangement, wherein the same size reflector feeds are provided about all four corners of the array.

As discussed to above, the location of the RF source with respect to the reflector determines the tilt of the beam. Therefore, one may use different sources at different locations to have beams tilted at different angles. For example, in FIG. 20D five sources, here in the form of pins, are used so have the array point to five different satellites. The sources and the distances between them are designed so that, in this example, the array may be used for digital television transmission using SAT 99, SAT 101 (at boresight), SAT 103, SAT 110, and SAT 119.

FIG. 20 F illustrates a flow chart for the design of a mixed array antenna. At first the radiating elements for the high and low bands are designed according to the design embodiment described above. Then the spacing of the high and low band elements are determined so as to provide maximum efficiency. This follow by fine-tuning the high band and low band array spacing and element dimensions in order to weight and control radiation pattern and gain on both bands. In one embodiment, the fine-tuning is done in favor of the high band. While accepting the resulting gain and performance of the low band. The high band radiation pattern is a superposition of the pattern generated by the high band array and the low band array. The low band array generates a grating lobe pattern in the high band, that is summed up with the pattern generated by the high band array and helps reduce the frequency scanning effect. The design and layout is then finalized by providing the reflector or other type of RF feed.

Figure 21A:
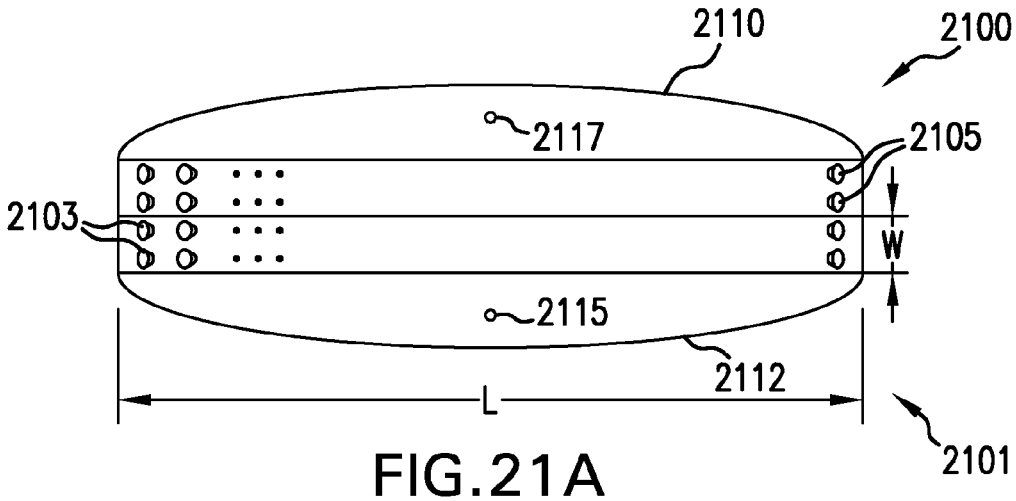
FIGS. 21A and 21B illustrate another embodiment of the invention enabling simultaneous dual polarization with wide-angle reception, and easily installable antenna.
Figure 21B:
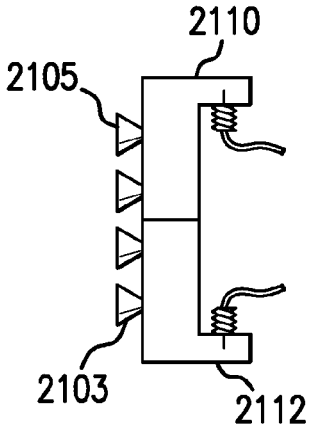

FIGS. 21A and 21B illustrate another embodiment of the invention enabling simultaneous dual polarization with wide-angle reception in one direction with a very short but wide form factor which presents a small form factor for the Human eye. The antenna of FIGS. 21A and 21B is beneficial in that it can be easily attached inconspicuously and need not be aimed precisely. The antenna of FIGS. 21A and 21B may beneficially utilize circularly polarizing elements such as, for example, the one illustrated in FIG. 8C, in conjunction with the inventive reflector feed. In this example, two long antennas 2100 and 2101 are made abutting each other. Antenna 2100 utilizes elements 2105 which provide, e.g., right hand circular polarization (RHCP), while antenna 2101 utilizes elements 2103 which provide counter circular polarization, i.e., left hand circular polarization (LHCP). Antenna 2100 utilizes reflector feed 2110 with radiating pin 2117, while antenna 2101 utilizes reflector feed 2112 with radiating pin 2115. Notably, in FIG. 21A the reflector feed is shown extending from the side of the antennas, while in FIG. 21B the reflector feed is folded.

Figure 22:
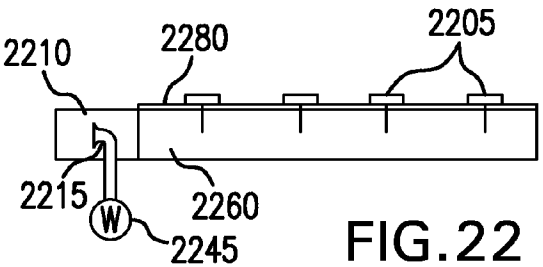
FIG. 22 illustrates an example of a reflector feed according to an embodiment of the invention, using a horn as an RF source.

It should be appreciated that any of the embodiments of the reflector feed described herein may use a fixed radiating pin, a movable radiating pin, or multiple radiating pins. In fact, the radiation does not necessarily be a pin. FIG. 22 illustrates an example of a reflector feed using a horn as an RF source. For this example, the embodiment of FIG. 16E is utilized, but it should be readily apparent that any of the other embodiment may be used as well. The array is constructed using a cavity 2260 having an insulating layer 2280 provided on its top, and patch radiating elements 2205 are provided on top of the insulating layer. The cavity 2260 is fed by reflector feed 2210 having a horn 2215 as an RF radiating source. The horn 2215 is fed with an RF energy by RF source 2245 in a conventional manner.

Figure 23:
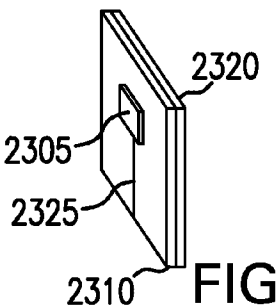
FIG. 23 illustrates an example of a patch radiation source which may be used with the reflector feed of the invention.

FIG. 23 illustrates an example of a patch radiation source which may be used with the reflector feed of the invention. The path feed of FIG. 23 may be used in any reflector feed constructed according to the invention. The patch radiation source of FIG. 23 is constructed of an insulating substrate 2310 having a conductive patch 2305 provided on one face thereof. The path is fed by a conductive trace 2325. The patch radiation source is affixed to the antenna so that the conductive patch faces the reflector. In one embodiment, as shown in FIG. 23, a conductive layer 2320 is provided on the backside of the substrate 2310. This functions to prevent any radiation from the patch to propagate directly into the cavity. In essence the conductive layer 2320 functions similarly to the counter reflector of FIG. 16.

The various antenna designs described herein may also incorporate a number of scanning technologies. For instance, an antenna system may be integrated into a mobile platform such as an automobile. Because the platform is moving and existing satellite systems are fixed with respect to the earth (geostationary), the receiving antenna should be able to track a signal coming from a satellite. Thus, a beam steering mechanism is preferably built into the system. Preferably, the beam steering element allows coverage over a two-dimensional, hemispherical space. Several configurations may be used. In one configuration, a one-dimensional electrical scan (e.g., phased array or switched feeds) coupled with mechanical rotation may be used. In one embodiment, the walls of a plurality of radiating elements may be mechanically rotated (e.g., by a motor) over a range of angles defined by the element wall in relation to the non-extruded surface of the waveguide. The rotation may be achieved for a range of angles to achieve a 360 degree azimuth range and an elevation range of from about 20-70 degrees. In another configuration, a two-dimensional lens scan may be incorporated. In this configuration, the antenna array may be designed to radiate at a fixed angle and a lens may be situated to interfere with the radiation. In one embodiment the lens is situated outwardly from the radiating elements. The lens has a saw-tooth configuration. By moving the lens back and forth along a direction parallel with the central axis of the waveguide, one may achieve a linear phase distribution along that direction. Thus, a radiated beam may be steered in a certain direction by controlling the movement of the lens. Superimposition of another lens orthogonal to the first may allow two-dimensional scanning. According to an alternative, one may use an irregularly shaped lens (which provides the equivalent of the movement of the two separate lenses) and then rotate the irregular lens to achieve two-dimensional scanning.

Some advantages of the invention may include, without limitation: (1) a two-dimensional structure which is flat and thin; (2) potential for extremely low cost and low mechanical tolerances fit for mass production; (3) built-in reflector and feed arrangement, which enables wide beam scanning without the need for expensive phase shifters or complicated feeding networks; (4) scalable to any frequency; (5) capability for multi-frequency operation in both two-way or one-way applications; (6) ability to accommodate high-power applications because of the simple low-loss structure with the absence of small dimension gaps. Some associated applications may include, without limitation: (1) one-way DBS mobile or fixed antenna system; (2) two-way mobile IP antenna system (3) mobile, fixed, and/or military SATCOM applications; (4) point-to-point or point-to-multipoint high frequency (up to approximately 100 GHz) band systems; (5) antennas for cellular base stations; (6) radar systems.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, perl, shell, PHP, Java, HFSS, CST, EEKO, etc.

The present invention has been described in relation to particular examples, which are intended in all respects to be illustrative rather than restrictive. Those skilled in the art will appreciate that many different combinations of hardware, software, and firmware will be suitable for practicing the present invention. Moreover, other implementations of the invention will be apparent to those skilled in the art from consideration of the specification and practice of the invention disclosed herein. It is intended that the specification and examples be considered as exemplary only, with a true scope and spirit of the invention being indicated by the following claims. It should also be noted that antenna radiation is a two-way process. Therefore, any description herein for transmitting radiation is equally applicable to reception of radiation and vice versa. Describing an embodiment with using only transmission or reception is done only for clarity, but the description is applicable to both transmission and reception. Additionally, while in the examples the arrays are shown symmetrically, this is not necessary. Other embodiments can be made having non-symmetrical arrays such as, for example, rectangular arrays.

The invention claimed is:

1. An RF feed comprising:

a parallel plate waveguide comprising a top plate, a bottom plate, and a side wall defining a cavity, wherein the sidewall comprises an opening serving as an excitation port and wherein the top plate and bottom plate are made of metal or a material coated with metal;

a curved reflector situated outside the cavity and coupled to the excitation port, the reflector configured to excite at the excitation port a planar electromagnetic wave in near field regime, such that the planar wave propagates within the waveguide; and a radiation source provided in the space between the excitation port and the curved reflector and radiating towards the curved reflector.

2. The RF feed of claim 1, wherein the curved reflector is one of: a three-dimensionally shaped surface, cylindrical, parabolic, or toroidal.

3. The RF feed of claim 1, further comprising an extension coupled between an opening in the waveguide and the curved reflector.

4. The RF feed of claim 3, wherein the extension is configured to situate the curved reflector under the waveguide.

5. The RF feed of claim 4, wherein the radiation source is positioned between the extension and the curved reflector.

6. The RF feed of claim 1, further comprising a counter-reflector situated opposite the radiation source and facing the curved reflector.

7. The RF feed of claim 1, wherein the radiation source comprises one of: a metallic pin, a waveguide horn opening, or a microstrip patch.

8. The RF feed of claim 1 wherein the top plate comprises at least one radiation coupling aperture, and further comprising a radiating element extending from the top plate over the coupling aperture, the element comprising a sidewall forming a distal opening spaced apart from the top plate, and the coupling aperture coupling wave energy of the planar electromagnetic wave between the waveguide and the radiating element.

9. The RF feed of claim 1, further comprising at least one patch radiating element provided on the top surface.

10. The RF feed of claim 1, further comprising an extension coupled to the opening in the sidewall, and wherein the curved reflector is provided under the bottom plate and is coupled to the extension.

11. The RF feed of claim 1, wherein the radiation source comprises a plurality of metallic pins arranged linearly.

12. The RF feed of claim 1, wherein the radiation source comprises a plurality of metallic pins arranged on a curve.

13. The RF feed of claim 1, wherein the radiation source comprises a plurality of waveguide horns.

14. The RF feed of claim 1, wherein the radiation source comprises a plurality of microstrip patches.

15. The RF feed of claim 1, wherein the curved reflector is shaped according to a function designed to reflect radiation received from the radiation source to thereby produce a linear wave front at the opening at the side of the waveguide.

16. The RF feed of claim 1, further comprising:

a second curved reflector coupled to a second opening at a second side of the waveguide; and a second radiation source provided in the space between the second opening at the second side of the waveguide and the second curved reflector.

17. The RF feed of claim 16, wherein the second curved reflector is shaped according to a function designed to reflect radiation received from the second radiation source to thereby produce a second linear wave front at the second opening at the second side of the waveguide.

18. The RF feed of claim 17, wherein the linear opening and the second opening are at right angles to each other.

19. The RF feed of claim 1, wherein the radiation source comprises a movable metallic pin.

20. The RF feed of claim 16, wherein the curved reflector is smaller than the second curved reflector.

* * * * *